US011872612B2

(12) United States Patent
Norikura

(10) Patent No.: US 11,872,612 B2
(45) Date of Patent: Jan. 16, 2024

(54) MULTISTAGE ROLLING MILL

(71) Applicant: SENDZIMIR JAPAN, LTD., Tokyo (JP)

(72) Inventor: Takashi Norikura, Tokyo (JP)

(73) Assignee: SENDZIMIR JAPAN, LTD., Tokyo (JP)

( * ) Notice: Subject to any disclaimer, the term of this patent is extended or adjusted under 35 U.S.C. 154(b) by 162 days.

(21) Appl. No.: 17/600,130

(22) PCT Filed: Apr. 1, 2020

(86) PCT No.: PCT/JP2020/015023
§ 371 (c)(1),
(2) Date: Sep. 30, 2021

(87) PCT Pub. No.: WO2020/204070
PCT Pub. Date: Oct. 8, 2020

(65) Prior Publication Data

US 2022/0168790 A1 Jun. 2, 2022

(30) Foreign Application Priority Data

Apr. 4, 2019 (JP) ..... 2019-072179

(51) Int. Cl.
*B21B 13/14* (2006.01)
*B21B 31/18* (2006.01)
(Continued)

(52) U.S. Cl.
CPC ..... *B21B 13/14* (2013.01); *B21B 31/18* (2013.01); *B21B 37/38* (2013.01)

(58) Field of Classification Search
CPC ..... B21B 13/14; B21B 13/18; B21B 13/16; B21B 13/142; B21B 13/145; B21B 37/38;
(Continued)

(56) References Cited

U.S. PATENT DOCUMENTS 3,818,743 A * 6/1974 Kajiwara ..... B21B 31/18 72/247
2001/0018840 A1 9/2001 Nihei et al.
(Continued)

FOREIGN PATENT DOCUMENTS

EP 3 130 408 A1 2/2017
JP 62-144803 A 6/1987
(Continued)

OTHER PUBLICATIONS

English translate (JP5711232B2), retrieved date Apr. 26, 2023.*
(Continued)

*Primary Examiner* — Matthew Katcoff
*Assistant Examiner* — Mohammed S. Alawadi
(74) *Attorney, Agent, or Firm* — MATTINGLY & MALUR, PC

(57) ABSTRACT

A multistage rolling mill 100 includes support bearings 10*a*, 10*b*, 10*c*, 10*d*, 10*e*, 10*f*, 10*g*, and 10*h* arranged on the entry side and/or the exit side of work rolls 2*a* and 2*b*, and supporting the work rolls 2*a* and 2*b* on an work side and a drive side. The offset positions in a pass direction of the pair of work rolls 2*a* and 2*b* for rolling a strip 1 are changed by moving in and out the support bearings 10*a*, 10*b*, 10*c*, 10*d*, 10*e*, 10*f*, 10*g*, and 10*h* to the entry side or the exit side with respect to the pass direction. A multistage rolling mill capable of rolling a hard material efficiently and suitable for obtaining a strip of high product quality is thereby provided.

10 Claims, 25 Drawing Sheets

(51) Int. Cl.

| | |
|---|---|
| ***B21B 37/38*** | (2006.01) |
| ***B21B 13/16*** | (2006.01) |
| ***B21B 31/20*** | (2006.01) |
| ***B21B 27/10*** | (2006.01) |

(58) Field of Classification Search
CPC ..... B21B 31/20; B21B 2027/103; B21B 2267/06; B21B 2269/12
USPC ..... 72/242.2, 242.4, 243.2, 243.4
See application file for complete search history.

(56) References Cited

U.S. PATENT DOCUMENTS

| | | | | |
|---|---|---|---|---|
| 2001/0020380 | A1* | 9/2001 | Yasuda | B21B 13/145 72/243.4 |
| 2006/0010952 | A1 | 1/2006 | Valence et al. | |
| 2006/0254335 | A1* | 11/2006 | Turley | B21B 13/145 72/243.2 |

FOREIGN PATENT DOCUMENTS

| | | | | |
|---|---|---|---|---|
| JP | 2001-232402 | A | 8/2001 | |
| JP | 2006-505413 | A | 2/2006 | |
| JP | 2006-315084 | A | 11/2006 | |
| JP | 2013-123742 | A | 6/2013 | |
| JP | 5711232 | B2 * | 4/2015 | B21B 13/147 |
| WO | 2012/008030 | A1 | 1/2012 | |

OTHER PUBLICATIONS

Chinese Office Action received in corresponding Chinese Application No. 202080025696.7 dated Jan. 18, 2023.
International Search Report of PCT/JP2020/015023 dated Jun. 23, 2020.

* cited by examiner

MULTISTAGE ROLLING MILL

TECHNICAL FIELD

The present invention relates to a multistage rolling mill for rolling a metal strip, and relates particularly to a multistage rolling mill suitable for obtaining high productivity and a strip of high product quality with regard to a hard material.

BACKGROUND ART

As an example of providing a novel side support structure incorporating a multiple-zone work roll cooling spray in a side-supported six-high rolling mill, Patent Document 1 states that the six-high rolling mill has work rolls having an offset with respect to intermediate rolls, whereby a net horizontal force acting so as to engage the work rolls with support rolls occurs during operation, and that horizontal support of the work rolls is substantially provided solely by the support rolls.

PRIOR ART DOCUMENT

Patent Document

Patent Document 1: JP-2006-315084-A

SUMMARY OF THE INVENTION

Problem to be Solved by the Invention

In a six-high rolling mill using small-diameter work rolls for conventional hard material rolling, a driving tangential force produced by intermediate roll driving is applied to the small-diameter work rolls.

In order to prevent bending of the small-diameter work rolls, as shown in FIG. 1 and FIG. 2, a structure is provided in which support rolls and support bearings supporting the small-diameter work rolls with a work roll offset amount of zero are arranged symmetrically on an entry side and an exit side over the entire length in a strip width direction on the entry side and the exit side of the small-diameter work rolls.

In addition, the above-described Patent Document 1 presents a structure in which support pads are provided on the entry side or the exit side of the work rolls.

However, the prior art including Patent Document 1 has a problem in that there is no space due to the provision of the support bearings and the support pads for supporting the entire length in the strip width direction. There is thus a problem of a difficulty in installing coolant spray headers for cooling the work rolls on the entry side of the mill and for controlling coolant zone flow rates for strip shape correction and cobble guards for removing water on the exit side of the mill.

In addition, when rolling torque is increased, the driving tangential force produced by the intermediate roll driving is increased. Therefore, there is a problem in that horizontal force applied to the work rolls is increased, and as a result, the life of the support bearings, in particular, in a support roll group is shortened.

In addition, the technology described in the foregoing Patent Document 1 has a structure in which the fixed support pads are provided on the entry side or the exit side of the work rolls. Thus, an instantaneous high load may be applied to the fixed support pads in a state in which the work rolls are rotating at a time of a strip breakage during rolling or the like. There is thus a fear of the support pads being worn greatly in that case.

It is accordingly an object of the present invention to provide a multistage rolling mill capable of rolling a hard material efficiently and suitable for obtaining a strip of high product quality to solve the above-described problems.

Means for Solving the Problems

The present invention includes a plurality of means for solving the above-described problems. To cite an example of the means, there is provided a multistage rolling mill including: a pair of work rolls rolling a metal strip; a pair of intermediate rolls supporting the work rolls; a pair of back-up rolls supporting the intermediate rolls; a first support roll group or support bearings arranged on an entry side and/or an exit side of the work rolls, the first support roll group or the support bearings supporting the work rolls on an work side and a drive side; and a coolant spray header and/or a cobble guard disposed in a strip width direction central portion of the metal strip, the intermediate rolls having tapered shaped roll shoulders in a direction of vertical point symmetry, and having shift devices shifting the intermediate rolls in a roll axis direction, and offset positions in a pass direction of at least either the work rolls or the intermediate rolls being changed by moving in and out at least either the first support roll group or the support bearings or chocks of the intermediate rolls to the entry side or the exit side with respect to the pass direction.

Advantages of the Invention

According to the present invention, it is possible to roll a hard material efficiently, and obtain a strip of high product quality. Problems, configurations, and effects other than those described above will be made apparent by the following description of embodiments.

MODES FOR CARRYING OUT THE INVENTION

Embodiments of a rolling mill according to the present invention will hereinafter be described with reference to the drawings.

First Embodiment

Figure 1:
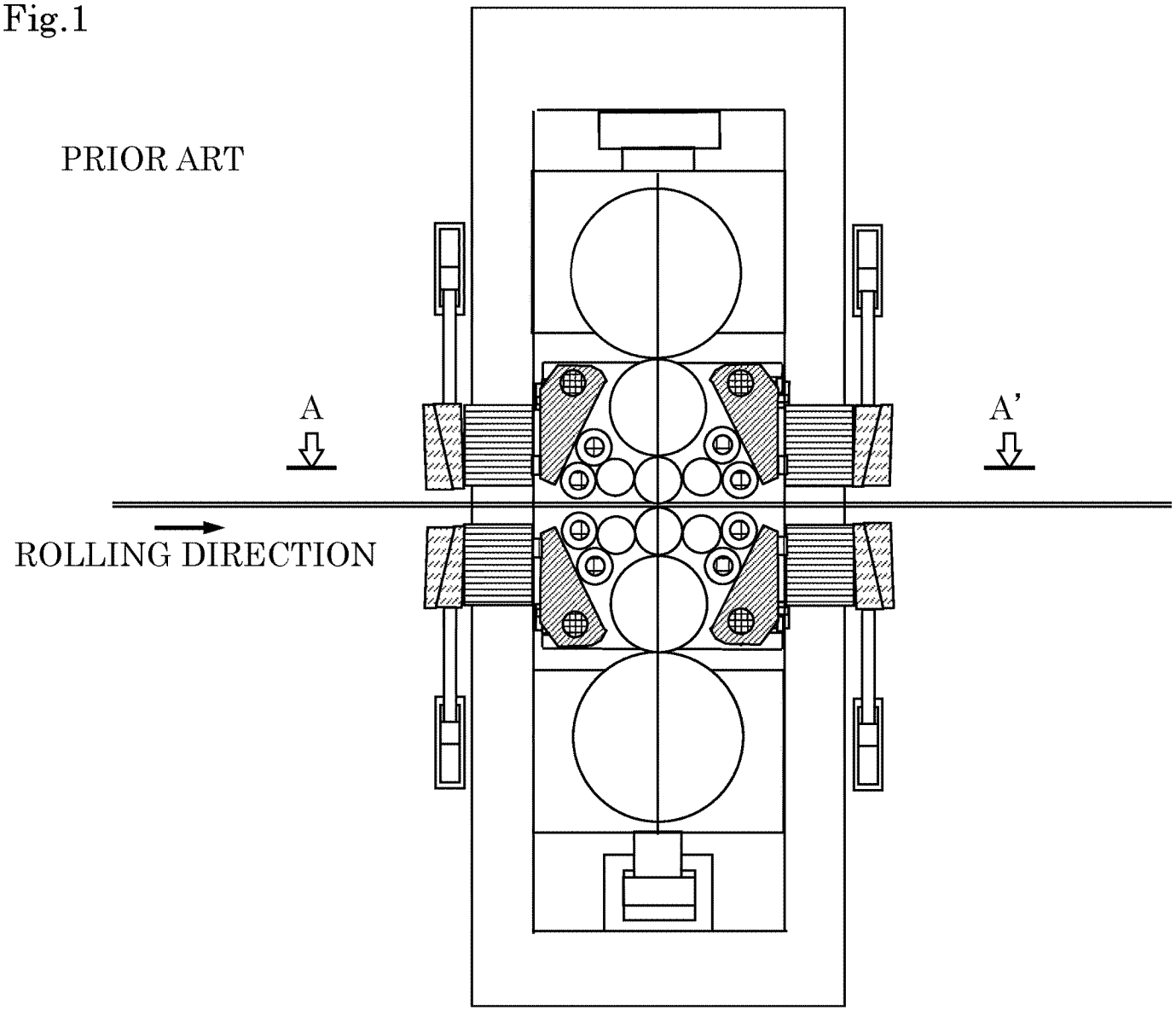
Fig.1 PRIOR ART
FIG. 1 is a diagram of assistance in explaining details of a conventional six-high rolling mill.
Figure 2:
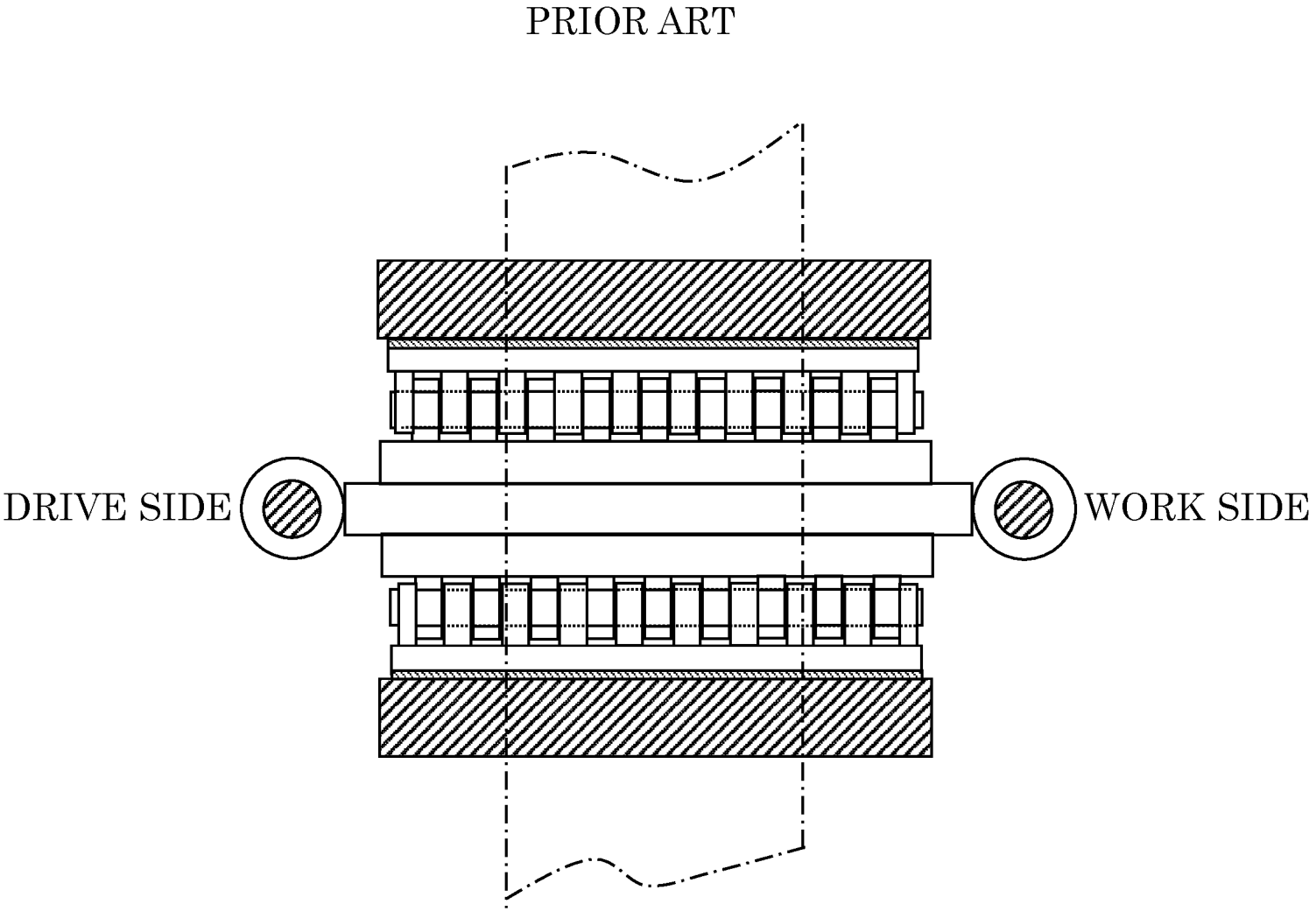
PRIOR ART Fig.2
FIG. 2 is a sectional view taken in the direction of arrows A-A' in FIG. 1.
Figure 3:
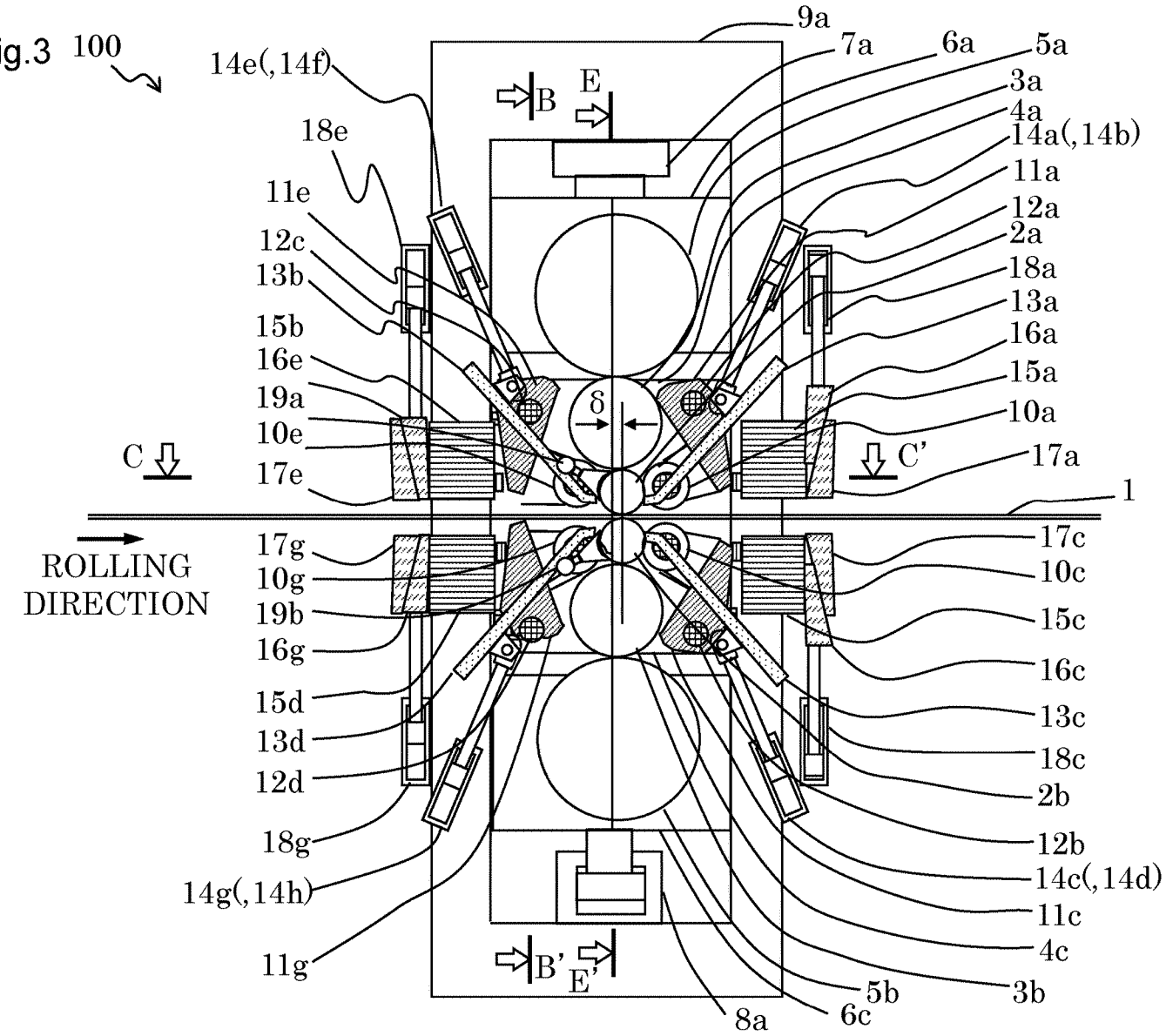
FIG. 3 is a front view of a six-high rolling mill according to a first embodiment of the present invention.
Figure 4:
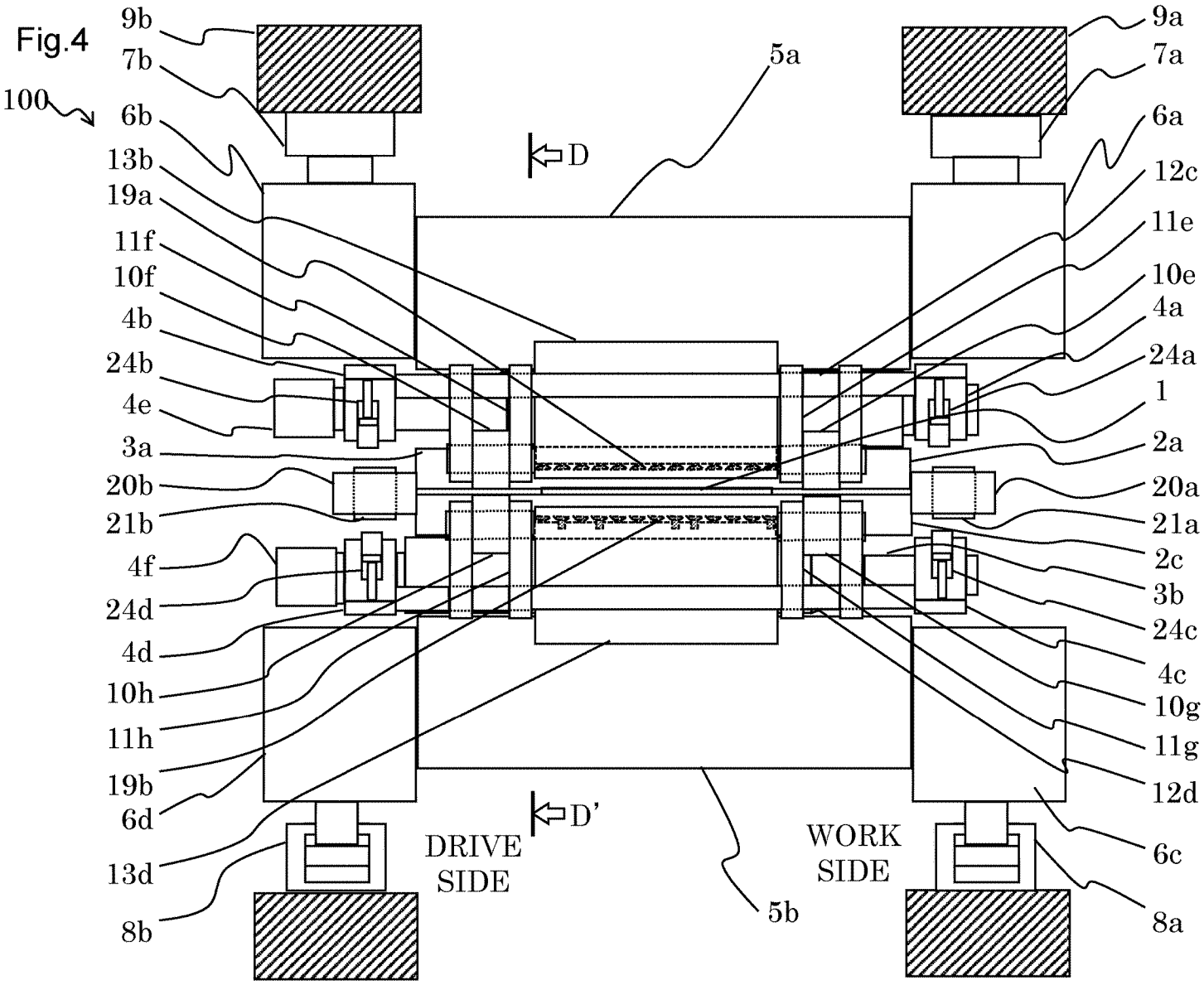
FIG. 4 is a sectional view taken in the direction of arrows B-B' in FIG. 3.
Figure 5:
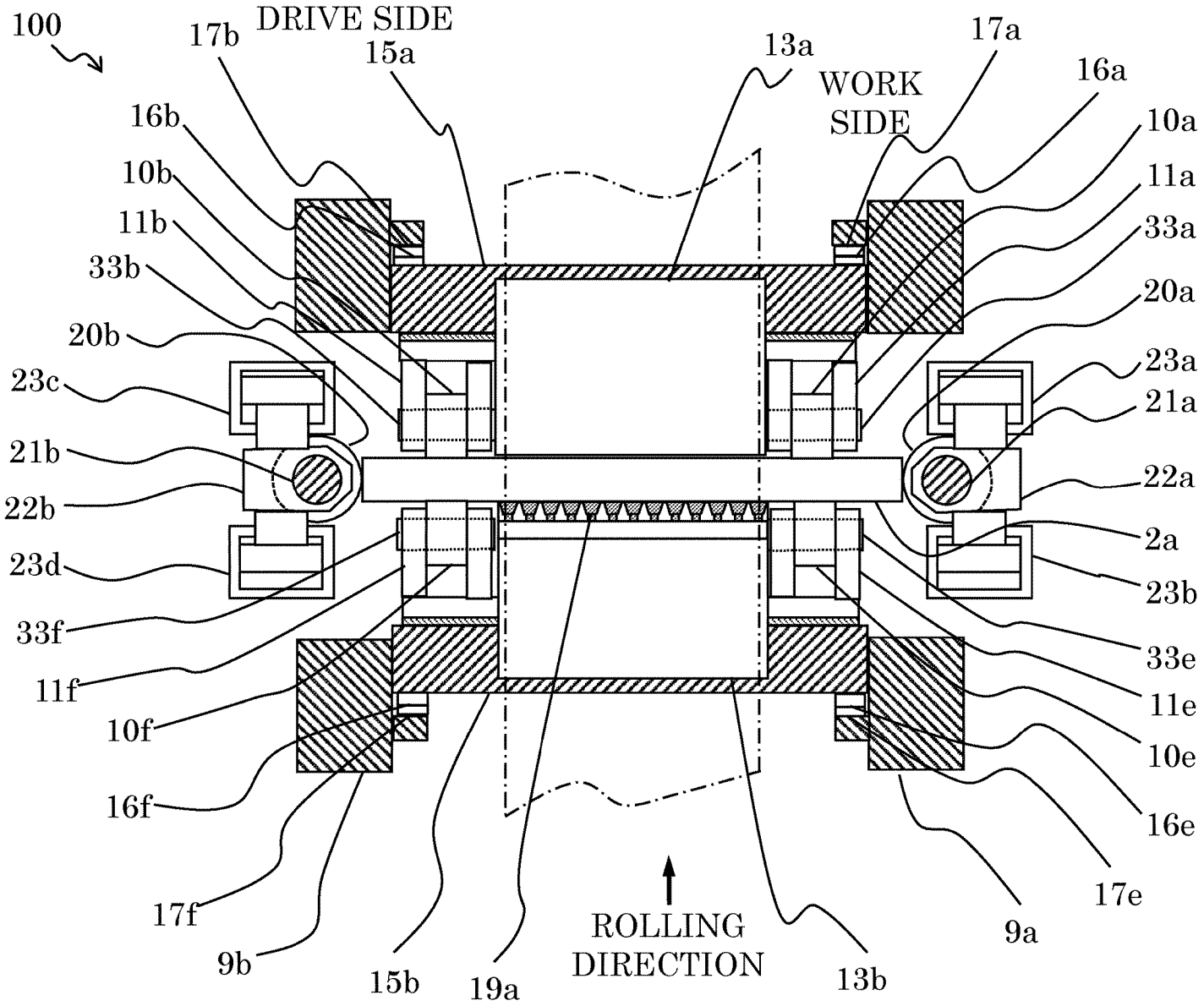
FIG. 5 is a sectional view taken in the direction of arrows C-C' in FIG. 3.
Figure 6:
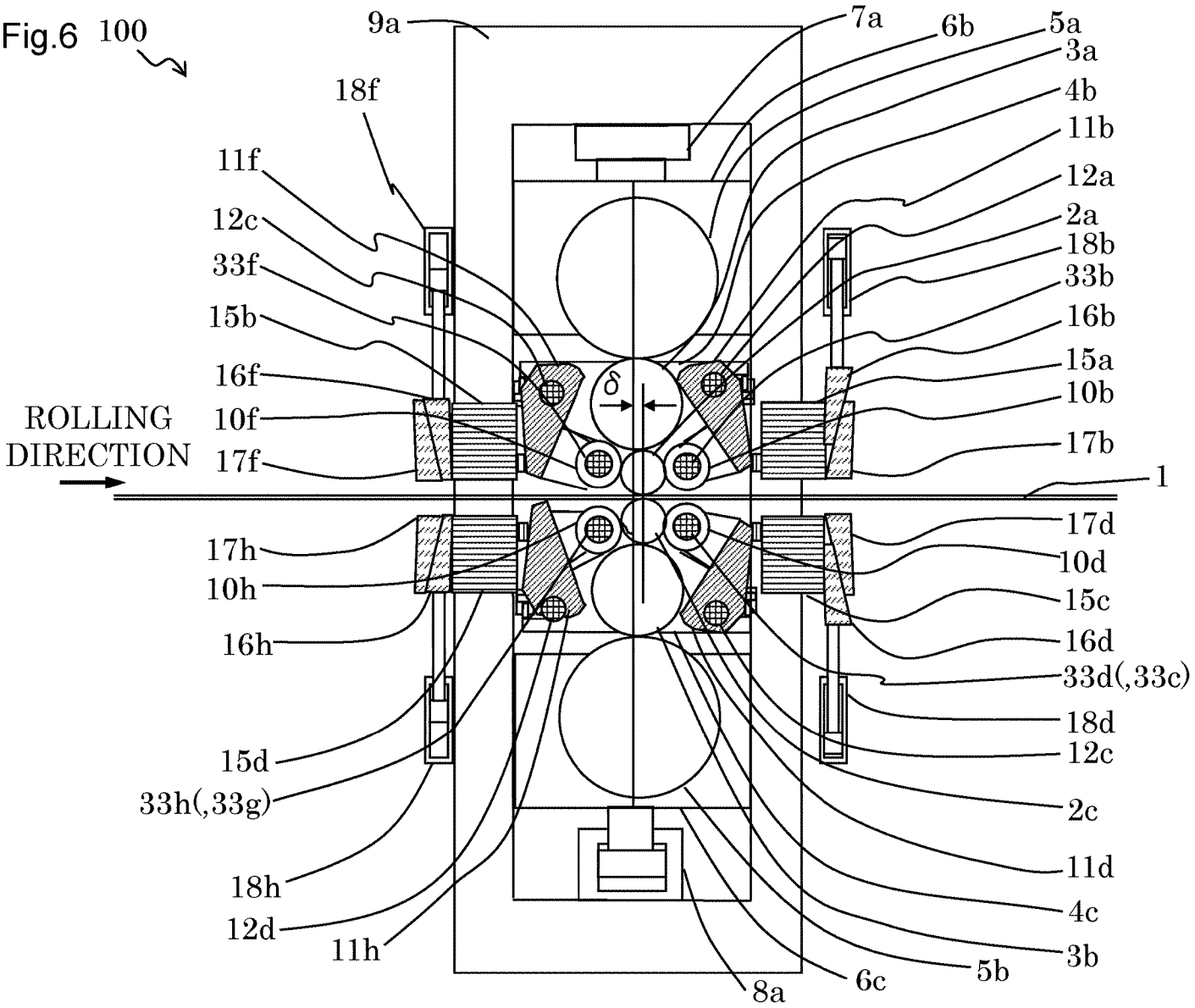
FIG. 6 is a sectional view taken in the direction of arrows D-D' in FIG. 4.
Figure 7:
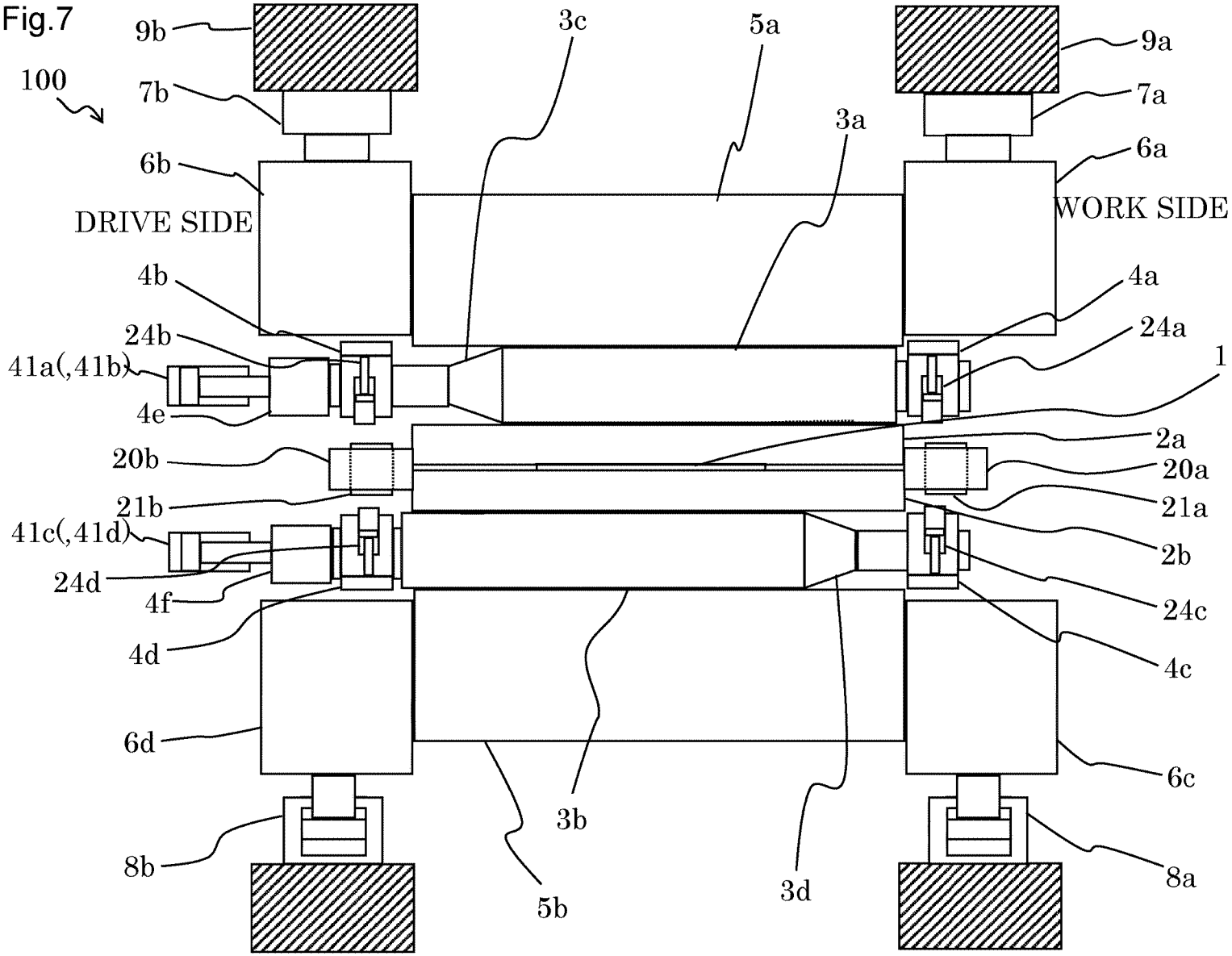
FIG. 7 is a sectional view taken in the direction of arrows E-E' in FIG. 3.
Figure 8:
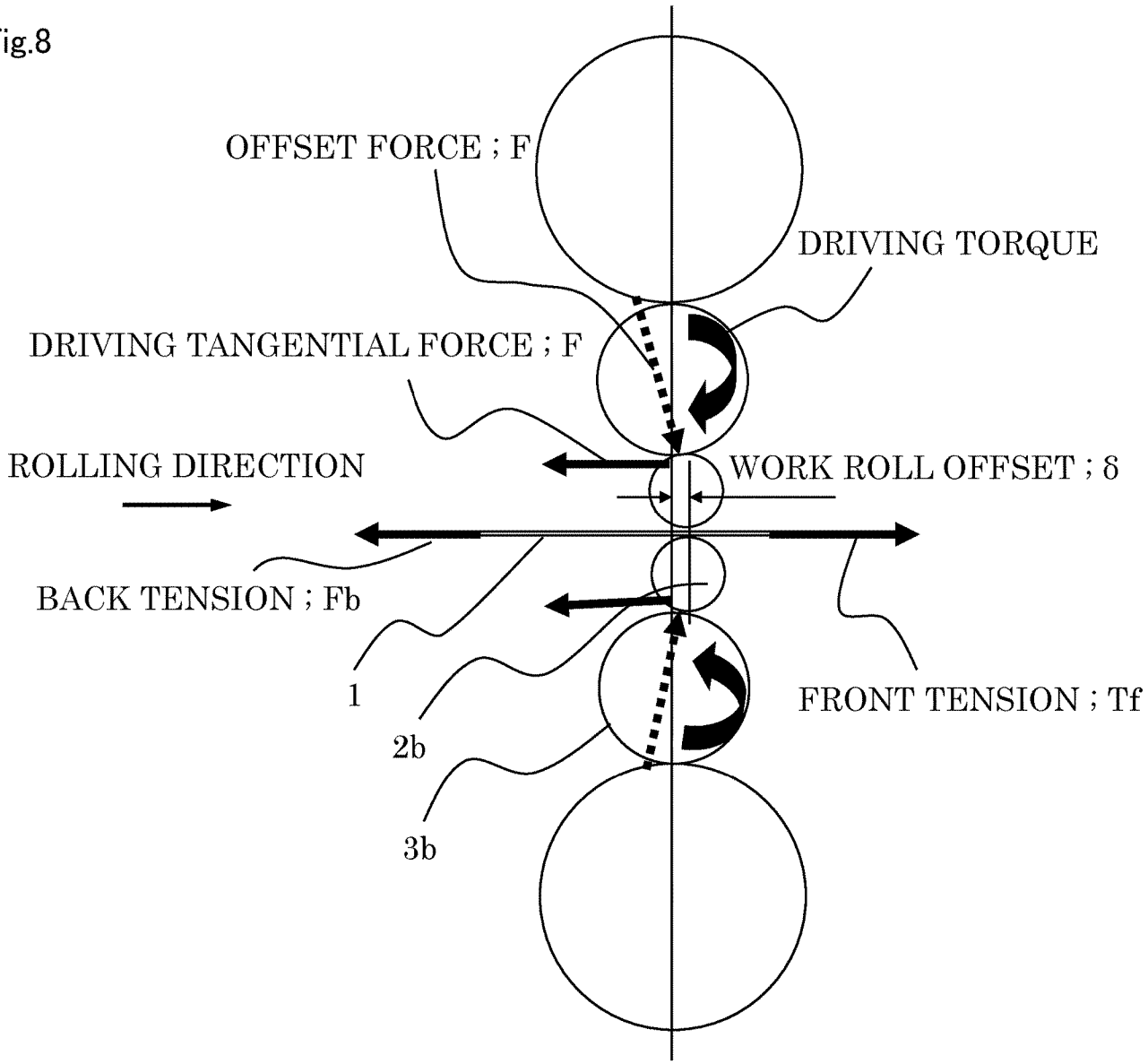
FIG. 8 is a diagram of assistance in explaining a state of an offset of work rolls in the first embodiment.
Figure 9:
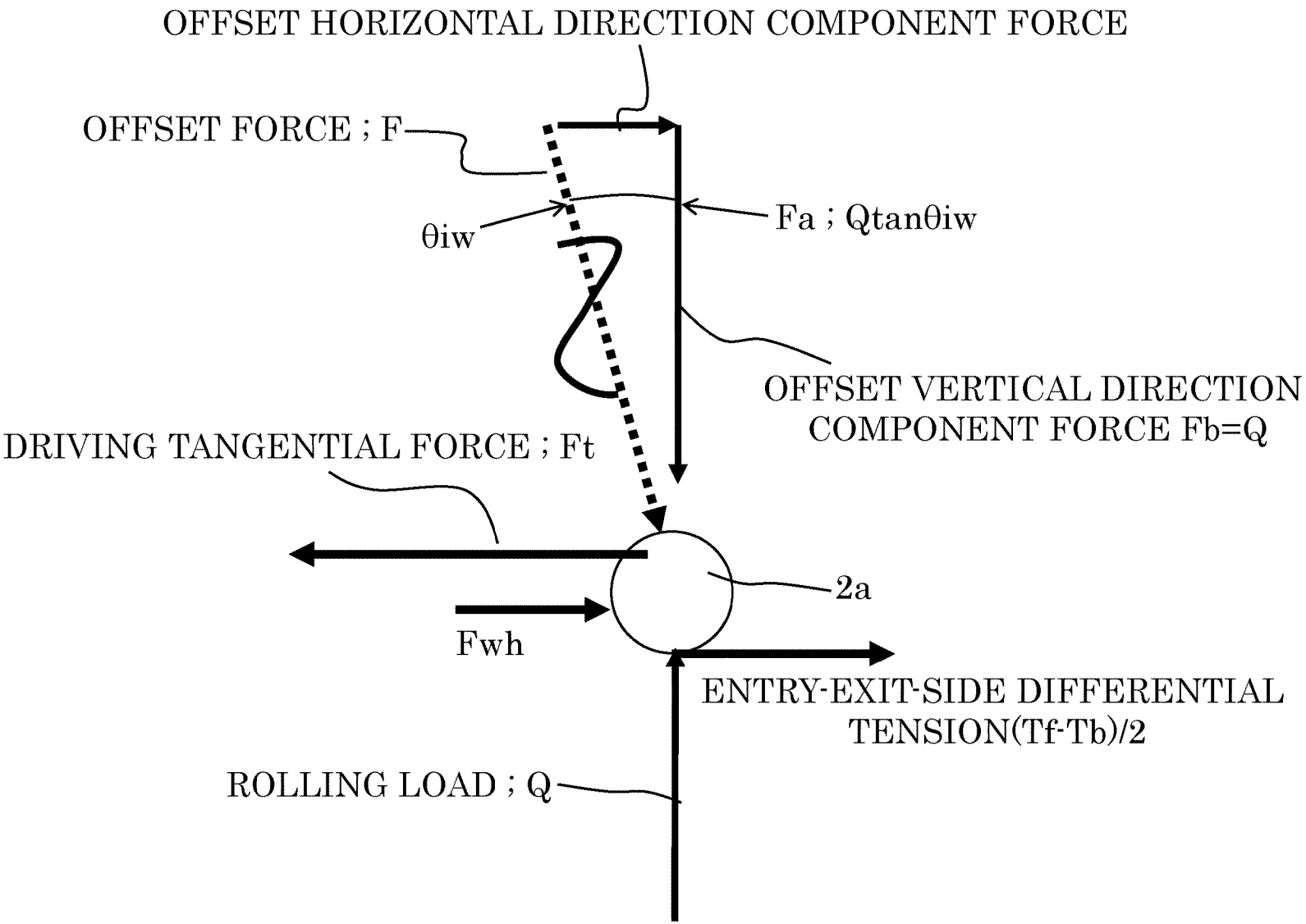
FIG. 9 is a diagram of assistance in explaining a balance between forces acting on the work rolls at a time of the offset of the work rolls in the first embodiment.
Figure 10:
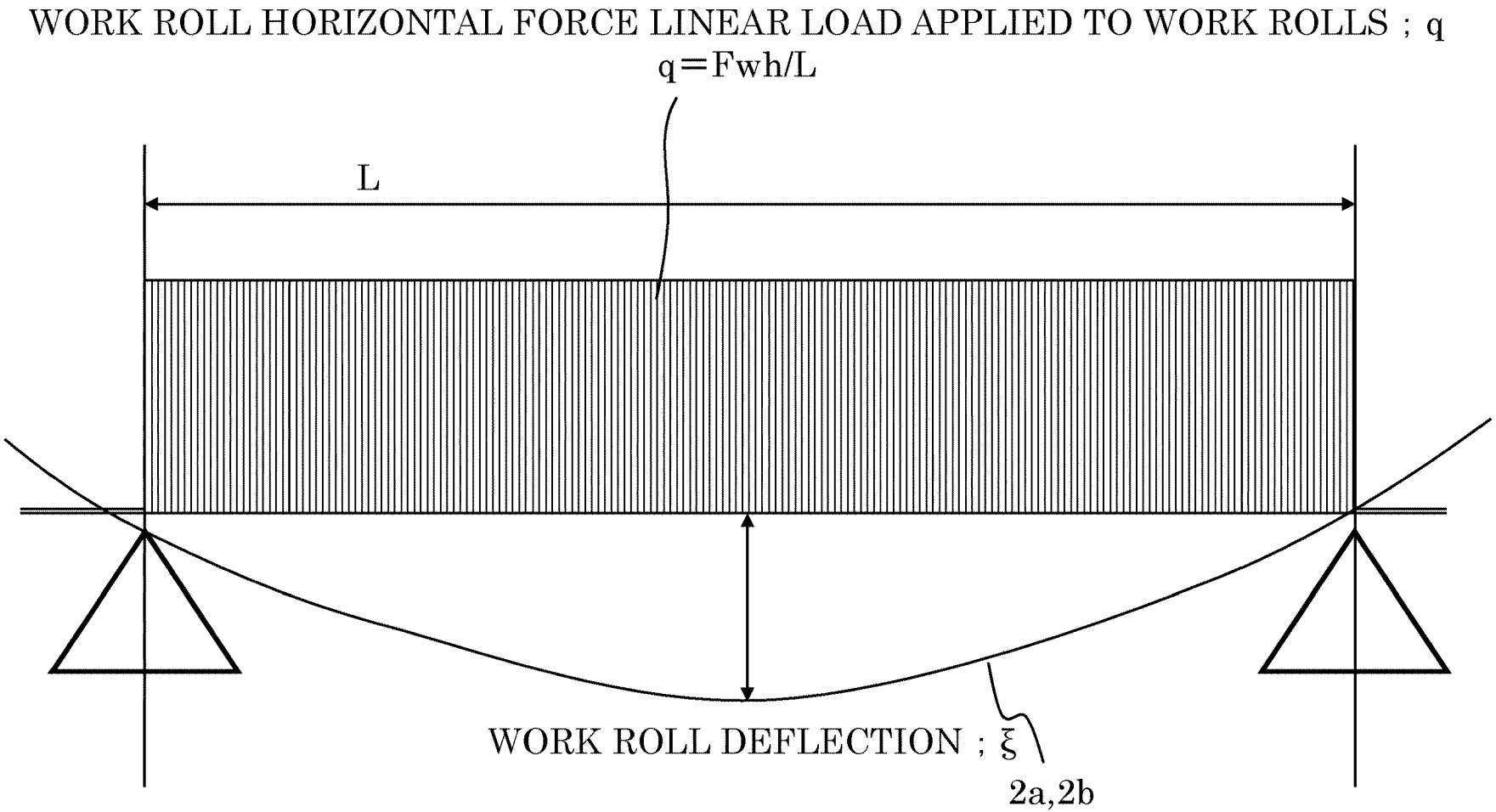
FIG. 10 is a diagram of assistance in explaining a state of bending of the work rolls in the first embodiment.

A first embodiment of the rolling mill according to the present invention will be described with reference to FIGS. 3 to 10. FIG. 3 is a front view of a six-high rolling mill according to the present embodiment. FIG. 4 is a sectional view taken in the direction of arrows B-B' in FIG. 3. FIG. 5 is a sectional view taken in the direction of arrows C-C' in FIG. 3. FIG. 6 is a sectional view taken in the direction of arrows D-D' in FIG. 4. FIG. 7 is a sectional view taken in the direction of arrows E-E' in FIG. 3. FIG. 8 is a diagram of assistance in explaining a state of an offset of work rolls in the present embodiment. FIG. 9 is a diagram of assistance in explaining a balance between forces acting on the work rolls at a time of the offset of the work rolls in the present embodiment. FIG. 10 is a diagram of assistance in explaining a state of bending of the work rolls in the present embodiment.

A multistage rolling mill 100 according to the present embodiment is a six-high rolling mill that rolls a strip 1. In FIG. 3, the multistage rolling mill 100 includes work rolls 2*a* and 2*b*, intermediate rolls 3*a* and 3*b*, and back-up rolls 5*a* and 5*b*.

As shown in FIGS. 3 to 7, further provided in addition to the work rolls 2*a* and 2*b*, the intermediate rolls 3*a* and 3*b*, and the back-up rolls 5*a* and 5*b* are intermediate roll chocks 4*a*, 4*b*, 4*c*, 4*d*, 4*e*, and 4*f*, back-up roll chocks 6*a*, 6*b*, 6*c*, and 6*d*, pass line adjusting devices 7*a* and 7*b*, hydraulic reduction cylinders 8*a* and 8*b*, mill housings 9*a* and 9*b*, support bearings 10*a*, 10*b*, 10*c*, 10*d*, 10*e*, 10*f*, 10*g*, and 10*h*, arms 11*a*, 11*b*, 11*c*, 11*d*, 11*e*, 11*f*, 11*g*, and 11*h*, shafts 12*a*, 12*b*, 12*c*, and 12*d*, cobble guards 13*a*, 13*b*, 13*c*, and 13*d*, hydraulic cylinders 14*a*, 14*b*, 14*c*, 14*d*, 14*e*, 14*f*, 14*g*, and 14*h*, side blocks 15*a*, 15*b*, 15*c*, and 15*d*, exit side tapered wedges 16*a*, 16*b*, 16*c*, and 16*d*, entry side tapered wedges 16*e*, 16*f*, 16*g*, and 16*h*, tapered wedges 17*a*, 17*b*, 17*c*, 17*d*, 17*e*, 17*f*, 17*g*, and 17*h*, hydraulic cylinders 18*a*, 18*b*, 18*c*, 18*d*, 18*e*, 18*f*, 18*g*, and 18*h*, coolant spray headers 19*a* and 19*b*, thrust bearings 20*a* and 20*b*, shafts 21*a* and 21*b*, brackets 22*a* and 22*b*, hydraulic cylinders 23*a*, 23*b*, 23*c*, and 23*d*, bending cylinders 24*a*, 24*b*, 24*c*, and 24*d*, shafts 33*a*, 33*b*, 33*c*, 33*d*, 33*e*, 33*f*, 33*g*, and 33*h*, shift cylinders 41*a*, 41*b*, 41*c*, and 41*d*, and the like.

Incidentally, parenthesized reference numerals in FIG. 3 and the like indicate objects difficult to show in the figures due to a same structure present on a near side. For example, it is indicated that the hydraulic cylinder 14*b* in FIG. 3 is present in a position that cannot be shown due to the hydraulic cylinder 14*a*. The same is true for other parenthesized reference numerals.

As shown in FIG. 3 and the like, the pair of upper and lower work rolls 2*a* and 2*b* rolls the strip 1 as a material to be rolled.

The pair of upper and lower work rolls 2*a* and 2*b* is respectively in contact with and supported by the pair of upper and lower intermediate rolls 3*a* and 3*b*. Further, the pair of upper and lower intermediate rolls 3*a* and 3*b* is respectively in contact with and supported by the pair of upper and lower back-up rolls 5*a* and 5*b*.

As shown in FIG. 7 and the like, the intermediate roll chocks 4*a*, 4*b*, and 4*e* are attached to roll neck portions of the intermediate roll 3*a* among these rolls via bearings omitted for the convenience of illustration. In addition, the intermediate roll chocks 4*c*, 4*d*, and 4*f* are attached to roll neck portions of the intermediate roll 3*b* via bearings omitted for the convenience of illustration.

As shown in FIG. 7, these intermediate roll chocks 4*a*, 4*b*, 4*c*, and 4*d* are respectively provided with the bending cylinders 24*a*, 24*b*, 24*c*, and 24*d* that apply roll bending. Roll bending is thereby applied to the intermediate rolls 3*a* and 3*b*.

In addition, the pair of upper and lower intermediate rolls 3*a* and 3*b* respectively has tapered shaped roll shoulders 3*c* and 3*d* in roll body end positions in a direction of vertical point symmetry with respect to the strip width center of the strip 1.

Further, the intermediate roll 3*a* is configured to be able to be shifted in a roll axis direction by the shift cylinders 41*a* and 41*b* as shown in FIG. 7 via the intermediate roll chock 4*e* on a drive side. In addition, the intermediate roll 3*b* is configured to be able to be shifted in the roll axis direction by the shift cylinders 41*c* and 41*d* as shown in FIG. 7 via the intermediate roll chock 4*f* on the drive side.

The back-up roll 5*a* on an upper side in a vertical direction is supported by bearings omitted for the convenience of illustration and the back-up roll chocks 6*a* and 6*b*. In addition, these back-up roll chocks 6*a* and 6*b* are supported by the housings 9*a* and 9*b* via the pass line adjusting devices 7*a* and 7*b*.

These pass line adjusting devices 7*a* and 7*b* are constituted by a worm jack, a tapered wedge and a stepped rocker strip, or the like. Preferably, a load cell is included within the pass line adjusting devices 7*a* and 7*b* to measure a rolling load.

In addition, the back-up roll 5*b* on a lower side in the vertical direction is supported by bearings omitted for the convenience of illustration and the back-up roll chocks 6*c* and 6*d*. In addition, these back-up roll chocks 6*c* and 6*d* are supported by the housings 9*a* and 9*b* via the hydraulic reduction cylinders 8*a* and 8*b*.

Returning to the work rolls 2*a* and 2*b*, as shown in FIG. 4 and the like, the work rolls 2*a* and 2*b* are supported by the thrust bearing 20*a* at axial ends on an work side, and are supported by the thrust bearing 20*b* at axial ends on the drive side. These thrust bearings 20*a* and 20*b* are respectively attached rotatably to the brackets 22*a* and 22*b* via the shafts 21*a* and 21*b*.

In addition, the brackets 22*a* and 22*b* are each supported by the hydraulic cylinders 23*a* and 23*b* or the hydraulic cylinders 23*c* and 23*d*.

Therefore, the pulling of the hydraulic cylinders 23*a* and 23*c* and the pushing of the hydraulic cylinders 23*b* and 23*d* can move the thrust bearings 20*a* and 20*b* to a pass direction exit side such that the centers of the thrust bearings 20*a* and 20*b* are aligned with each other. The centers of the thrust bearings 20*a* and 20*b* can be thereby offset to the pass direction exit side of the work rolls 2*a* and 2*b*.

In addition, the pushing of the hydraulic cylinders 23*a* and 23*c* and the pulling of the hydraulic cylinders 23*b* and 23*d* can move the thrust bearings 20*a* and 20*b* to a pass direction entry side such that the centers of the thrust bearings 20*a* and 20*b* are aligned with each other. The centers of the thrust bearings 20*a* and 20*b* can be thereby offset to the pass direction entry side of the work rolls 2*a* and 2*b*.

Incidentally, in a case of a small amount of offset in the pass direction of the work rolls 2*a* and 2*b*, the thrust bearings 20*a* and 20*b* do not need to be moved in the pass direction such that the centers of the thrust bearings 20*a* and 20*b* are aligned with each other.

In the multistage rolling mill 100 according to the present embodiment, as shown in FIG. 5 and the like, on a horizontal direction exit side, the above-described work roll 2*a* is rotatably supported by the support bearing 10*a* installed on the work side and the support bearing 10*b* installed on the drive side. On the horizontal direction entry side, the work roll 2*a* is rotatably supported by the support bearing 10*e* installed on the work side and the support bearing 10*f* installed on the drive side.

In addition, on the horizontal direction exit side, the work roll 2*b* is rotatably supported by the support bearing 10*c* installed on the work side and the support bearing 10*d* installed on the drive side. On the horizontal direction entry side, the work roll 2*b* is rotatably supported by the support bearing 10*g* installed on the work side and the support bearing 10*h* installed on the drive side.

In addition, these support bearings 10*a*, 10*b*, 10*c*, 10*d*, 10*e*, 10*f*, 10*g*, and 10*h* are rotatably supported by the arms 11*a*, 11*b*, 11*c*, 11*d*, 11*e*, 11*f*, 11*g*, and 11*h*, respectively, via the shafts 33*a*, 33*b*, 33*c*, 33*d*, 33*e*, 33*f*, 33*g*, and 33*h*, respectively.

Among these arms 11*a*, 11*b*, 11*c*, 11*d*, 11*e*, 11*f*, 11*g*, and 11*h*, the arms 11*a* and 11*b* are respectively swingably attached to the intermediate roll chocks 4*a* and 4*b* via the shaft 12*a*. In addition, the arms 11*e* and 11*f* are respectively swingably attached to the intermediate roll chocks 4*a* and 4*b* via the shaft 12*c*. The arms 11*c* and 11*d* are respectively swingably attached to the intermediate roll chocks 4*c* and 4*d* via the shaft 12*b*. The arms 11*g* and 11*h* are respectively swingably attached to the intermediate roll chocks 4*c* and 4*d* via the shaft 12*d*.

These intermediate roll chocks 4*a*, 4*b*, 4*c*, and 4*d* correspond to chocks for the intermediate rolls 3*a* and 3*b*.

In addition, the arms 11*a* and 11*b* are supported in the pass direction by the side block 15*a*. The side block 15*a* is supported by the housing 9*a* via the exit side tapered wedges 16*a* and 16*b* and the tapered wedges 17*a* and 17*b*.

The arms 11*c* and 11*d* are supported in the pass direction by the side block 15*c*. The side block 15*c* is supported by the housing 9*b* via the exit side tapered wedges 16*c* and 16*d* and the tapered wedges 17*c* and 17*d*.

The arms 11*e* and 11*f* are supported in the pass direction by the side block 15*b*. Further, the side block 15*b* is supported by the housing 9*a* via the entry side tapered wedges 16*e* and 16*f* and the tapered wedges 17*e* and 17*f*.

The arms 11*g* and 11*h* are supported in the pass direction by the side block 15*d*. The side block 15*d* is supported by the housing 9*b* via the entry side tapered wedges 16*g* and 16*h* and the tapered wedges 17*g* and 17*h*.

The tapered wedges 16*a*, 16*b*, 16*c*, 16*d*, 16*e*, 16*f*, 16*g*, and 16*h* can be respectively changed in insertion thickness to the tapered wedges 17*a*, 17*b*, 17*c*, 17*d*, 17*e*, 17*f*, 17*g*, and 17*h* sides by being inserted and pulled by the hydraulic cylinders 18*a*, 18*b*, 18*c*, 18*d*, 18*e*, 18*f*, 18*g*, and 18*h*.

For example, when the entry side tapered wedges 16*e*, 16*f*, 16*g*, and 16*h* are pushed in, the thickness of the entry side tapered wedges 16*e*, 16*f*, 16*g*, and 16*h* is increased, the side blocks 15*b* and 15*d* are correspondingly moved to the exit side, and the work rolls 2*a* and 2*b* are moved to the exit side by an offset δ via the arms 11*e*, 11*f*, 11*g*, and 11*h*, the shafts 33*e*, 33*f*, 33*g*, and 33*h*, and the support bearings 10*e*, 10*f*, 10*g*, and 10*h*.

At the same time, when the exit side tapered wedges 16*a*, 16*b*, 16*c*, and 16*d* are pulled, the thickness of the exit side tapered wedges 16*a*, 16*b*, 16*c*, and 16*d* is decreased, the side blocks 15*a* and 15*c* are correspondingly moved to the exit side, and the support bearings 10*a*, 10*b*, 10*c*, and 10*d* are also moved to the exit side by δ via the arms 11*a*, 11*b*, 11*c*, and 11*d* and the shafts 33*a*, 33*b*, 33*c*, and 33*d*, and support the work rolls 2*a* and 2*b*.

In contrast, when the exit side tapered wedges 16*a*, 16*b*, 16*c*, and 16*d* are pushed in, the thickness of the exit side tapered wedges 16*a*, 16*b*, 16*c*, and 16*d* is increased, the side blocks 15*a* and 15*c* are correspondingly moved to the entry side, and the work rolls 2*a* and 2*b* are moved to the entry side by a desired amount of offset via the arms 11*a*, 11*b*, 11*c*, and 11*d*, the shafts 33*a*, 33*b*, 33*c*, and 33*d*, and the support bearings 10*a*, 10*b*, 10*c*, and 10*d*.

At the same time, when the entry side tapered wedges 16*e*, 16*f*, 16*g*, and 16*h* are pulled, the thickness of the entry side tapered wedges 16*e*, 16*f*, 16*g*, and 16*h* is decreased, the side blocks 15*b* and 15*d* are correspondingly moved to the entry side, and the support bearings 10*e*, 10*f*, 10*g*, and 10*h* are also moved to the entry side by a desired amount of offset via the arms 11*e*, 11*f*, 11*g*, and 11*h* and the shafts 33*e*, 33*f*, 33*g*, and 33*h*, and support the work rolls 2*a* and 2*b*.

Incidentally, while a system has been illustrated in which the tapered wedges 16*a*, 16*b*, 16*c*, 16*d*, 16*e*, 16*f*, 16*g*, and 16*h* are moved in and out by the hydraulic cylinders 18*a*, 18*b*, 18*c*, 18*d*, 18*e*, 18*f*, 18*g*, and 18*h* in the present embodiment, a motor-driven worm jack system can be used in place of the hydraulic cylinders 18*a*, 18*b*, 18*c*, 18*d*, 18*e*, 18*f*, 18*g*, and 18*h*.

Returning to FIG. 3, the work rolls 2*a* and 2*b* are provided with the cobble guards 13*b* and 13*d* on the entry side of a strip width direction central part of the strip 1. In addition, the cobble guards 13*b* and 13*d* are provided with the coolant spray headers 19*a* and 19*b*.

The coolant spray headers 19*a* and 19*b* cool and lubricate the work rolls 2*a* and 2*b*. Further, the coolant spray headers 19*a* and 19*b* can be provided with a plurality of zones in a strip width direction, and thereby vary or switch on or off the flow rate of a coolant for each of the zones. High-accuracy strip shape control is thereby made possible.

For example, where the strip is locally tight (not stretched) in the strip width direction, the flow rate of the coolant in a zone at the same position in the strip width direction of the coolant spray headers 19*a* and 19*b* is decreased or switched off. The cooling of the parts of the work rolls 2*a* and 2*b* is thereby suppressed, the thermal expansion of the parts is increased, and the diameter of the parts is correspondingly increased. As a result, the strip shape is stretched from a state in which only the parts are tight, and the strip shape becomes a flat shape.

The cobble guards 13*b* and 13*d* can be retracted by the hydraulic cylinders 14*e* and 14*g* fixed to the mill housings 9*a* and 9*b* at a time of roll replacement of the intermediate rolls 3*a* and 3*b*.

While the present embodiment illustrates an example in which the coolant spray headers 19*a* and 19*b* are installed on only the entry side, the coolant spray headers 19*a* and 19*b* can be installed on only the exit side, or the coolant spray headers 19*a* and 19*b* can be installed on both of the entry side and the exit side. In addition, while the application of the plurality of zones in the strip width direction for strip shape control of the coolant spray header 19*a* is effective on only the upper side, effects thereof are increased when the plurality of zones are provided also to the lower side.

In addition, for a purpose of preventing broken pieces of the strip from being caught in the rolls at a time of a strip breakage on the exit side of the mill and a purpose of removing water, the cobble guards 13*a* and 13*c* are provided on the exit side of central parts of the work rolls 2*a* and 2*b* in the strip width direction of the strip 1. The coolant is thereby prevented from falling onto the strip.

Incidentally, the present embodiment illustrates an example in which the support bearings 10*a*, 10*b*, 10*c*, 10*d*, 10*e*, 10*f*, 10*g*, and 10*h*, the shafts 33*a*, 33*b*, 33*c*, 33*d*, 33*e*, 33*f*, 33*g*, and 33*h*, and the arms 11*a*, 11*b*, 11*c*, 11*d*, 11*e*, 11*f*, 11*g*, and 11*h* are swingably attached to the intermediate roll chocks 4*a*, 4*b*, 4*c*, and 4*d* via the shafts 12*a*, 12*b*, 12*c*, and 12*d*.

However, the support bearings 10*a*, 10*b*, 10*c*, 10*d*, 10*e*, 10*f*, 10*g*, and 10*h*, the shafts 33*a*, 33*b*, 33*c*, 33*d*, 33*e*, 33*f*, 33*g*, and 33*h*, and the arms 11*a*, 11*b*, 11*c*, 11*d*, 11*e*, 11*f*, 11*g*, and 11*h* can be swingably attached to the side blocks 15*a*, 15*b*, 15*c*, and 15*d* via the shafts 12*a*, 12*b*, 12*c*, and 12*d*.

In addition, a structure can be adopted in which the support bearings 10*a*, 10*b*, 10*c*, 10*d*, 10*e*, 10*f*, 10*g*, and 10*h* are directly supported by hydraulic cylinders or worm jacks.

Further, description has been made of a case where the cobble guards 13*b* and 13*d* to which the coolant spray headers 19*a* and 19*b* are attached and the cobble guards 13*a* and 13*c* can be retracted by the hydraulic cylinders 14*a*, 14*b*, 14*c*, 14*d*, 14*e*, 14*f*, 14*g*, and 14*h* fixed to the mill housings 9*a* and 9*b*. However, the cobble guards 13*b* and 13*d* to which the coolant spray headers 19*a* and 19*b* are attached and the cobble guards 13*a* and 13*c* can be mounted on the intermediate roll chocks 4*a*, 4*b*, 4*c*, and 4*d*. In addition, the coolant spray headers 19*a* and 19*b* may be included in the side blocks 15*b* and 15*d*.

In the following, a method of setting offset positions of the work rolls 2*a* and 2*b* will be described with reference to FIGS. 8 to 10.

First, in a case of a system that drives the intermediate rolls 3*a* and 3*b*, as shown in FIG. 8 and FIG. 9, a work roll horizontal force Fwh applied to the work rolls 2*a* and 2*b* is expressed by Equation (1) shown in the following.

$$Fwh=Ft-Q\cdot\tan(\theta iw)-(Tf-Tb)/2 \quad (1)$$

where Q denotes a rolling load, and is computed from a quantity measurable by a load cell or the pressure of the hydraulic reduction cylinders 8*a* and 8*b*. Tf and Tb respectively denote an exit side tension and an entry side tension. The values are measured by a tension meter or the like omitted for the convenience of illustration.

Letting δ be an amount of offset of the work rolls 2*a* and 2*b* as shown in FIG. 8 and FIG. 9, θiw in Equation (1) is obtained by Equation (2) shown in the following.

$$\mathrm{Sin}(\theta iw)=\delta/((Di+Dw)/2)) \quad (2)$$

where Dw and Di in Equation (2) respectively denote the diameter of the work rolls 2*a* and 2*b* and the diameter of the intermediate rolls 3*a* and 3*b*.

In addition, a driving tangential force Ft in Equation (1) is obtained by Equation (3) shown in the following.

$$Ft=(Ti/2)/(Di/2) \quad (3)$$

where Ti in Equation (3) denotes a total value of vertical driving torque of the intermediate rolls 3*a* and 3*b*.

That is, it is clear from these Equations (1) to (3) that the work roll horizontal force Fwh applied to the work rolls 2*a* and 2*b* can be reduced by changing the work roll offset amount δ.

Hence, as shown in FIG. 10, a linear load q obtained by dividing the work roll horizontal force Fwh by a length L of the work rolls 2*a* and 2*b* can be reduced. In addition, because of the low linear load q, deflection ξ of the work rolls 2*a* and 2*b* can be suppressed, and consequently strip shape defects can be reduced.

For this purpose, the work roll offset amount δ is set such that the work roll deflection ξ is a value in the vicinity of zero or a fixed value as an allowable value.

Here, the work roll deflection ξ is expressed by the following Equation (4) from an equation of simple support of a beam.

$$\xi=(5\cdot q\cdot L^4)/(384\cdot E\cdot I) \quad (4)$$

where E in Equation (4) denotes a modulus of longitudinal elasticity of the work rolls 2*a* and 2*b*, and I denotes a geometrical moment of inertia of the work rolls 2*a* and 2*b*.

In the present embodiment described above, as for a range of the diameter of the work rolls 2*a* and 2*b*, small diameters such that D (work roll diameter)/B (strip width)=0.08 to 0.16 are particularly suitable. However, there is no limitation to the work roll diameters.

Effects of the present embodiment will next be described.

The multistage rolling mill 100 according to the foregoing first embodiment of the present invention includes: the pair of work rolls 2*a* and 2*b* configured to roll the strip 1; the pair of intermediate rolls 3*a* and 3*b* configured to support the work rolls 2*a* and 2*b*; the pair of back-up rolls 5*a* and 5*b* configured to support the intermediate rolls 3*a* and 3*b*; the support bearings 10*a*, 10*b*, 10*c*, 10*d*, 10*e*, 10*f*, 10*g*, and 10*h* arranged on the entry side and the exit side of the work rolls 2*a* and 2*b* and configured to support the work rolls 2*a* and 2*b* on the work side and the drive side; and the coolant spray headers 19*a* and 19*b* and the cobble guards 13*a*, 13*b*, 13*c*, and 13*d* arranged at a strip width direction central portion of the strip 1, the intermediate rolls 3*a* and 3*b* having tapered shaped roll shoulders 3*c* and 3*d* in a direction of vertical point symmetry, and having the shift cylinders 41*a*, 41*b*, 41*c*, and 41*d* configured to shift the intermediate rolls 3*a* and 3*b* in the roll axis direction, and the offset positions in the pass direction of the work rolls 2*a* and 2*b* being changed by moving in and out the support bearings 10*a*, 10*b*, 10*c*, 10*d*, 10*e*, 10*f*, 10*g*, and 10*h* to the entry side or the exit side with respect to the pass direction.

Thus, the coolant spray headers 19*a* and 19*b* for cooling the work rolls on the entry side of the mill and for controlling coolant zone flow rates for strip shape correction and the cobble guards 13*a*, 13*b*, 13*c*, and 13*d* for removing water on the exit side of the mill can be installed in a space of the strip width direction center of the strip 1. Therefore, for example, the coolant spray headers 19*a* and 19*b* can effectively perform roll cooling of the entry side of the work rolls 2*a* and 2*b*, so that rolling at high speed is made possible. In addition, the cobble guards 13*a*, 13*b*, 13*c*, and 13*d* can be installed, and can remove water on the exit side of the mill. Thus, this also makes high-speed rolling possible. In addition, coolant zone flow rates can be controlled, so that an excellent strip shape is obtained.

In addition, since the work rolls 2*a* and 2*b* are not supported over the entire length in the strip width direction of the work rolls 2*a* and 2*b*, an increase in bending of the work rolls occurs, and a strip shape defect may occur as a result. However, an amount of offset on the entry side or the exit side of the work rolls 2*a* and 2*b* is changed to reduce the strip shape defect. It is thereby possible to reduce the horizontal force applied to the work rolls 2*a* and 2*b*, suppress bending of the work rolls 2*a* and 2*b*, and reduce the strip shape defect.

Further, the work rolls 2*a* and 2*b* are supported by the rotatable support bearings 10*a*, 10*b*, 10*c*, 10*d*, 10*e*, 10*f*, 10*g*, and 10*h* rather than fixed pads on only the work side and the drive side rather than over the entire length in the strip width direction of the work rolls 2*a* and 2*b*. Thus, a strip of excellent surface quality can be obtained without a fear of a bearing mark, and the life of the support bearings can be lengthened. In addition, an effect of obviating a need for using fixed pads that may be worn greatly at a time of a strip breakage during rolling or the like is obtained.

Such a multistage rolling mill 100 according to the present embodiment is particularly suitable for rolling a hard material, and is a rolling mill very suitable for obtaining high productivity and a strip of high product quality.

In addition, since the support bearings 10*a*, 10*b*, 10*c*, 10*d*, 10*e*, 10*f*, 10*g*, and 10*h* are moved in and out to the entry side or the exit side with respect to the pass direction, bending can be suppressed by offsetting the work rolls 2*a* and 2*b* reliably and easily according to conditions for rolling the strip 1.

Further, the support bearings 10*a*, 10*b*, 10*c*, 10*d*, 10*e*, 10*f*, 10*g*, and 10*h* are rotatably installed on the arms 11*a*, 11*b*, 11*c*, 11*d*, 11*e*, 11*f*, 11*g*, and 11*h* swingably coupled to the chocks for the intermediate rolls 3*a* and 3*b*. An amount of offset of the work rolls 2*a* and 2*b* can be adjusted with high accuracy by adjusting the pass direction positions of the arms 11*a*, 11*b*, 11*c*, 11*d*, 11*e*, 11*f*, 11*g*, and 11*h* by the side blocks 15*a*, 15*b*, 15*c*, and 15*d* capable of adjusting the pass direction positions.

Figure 14:
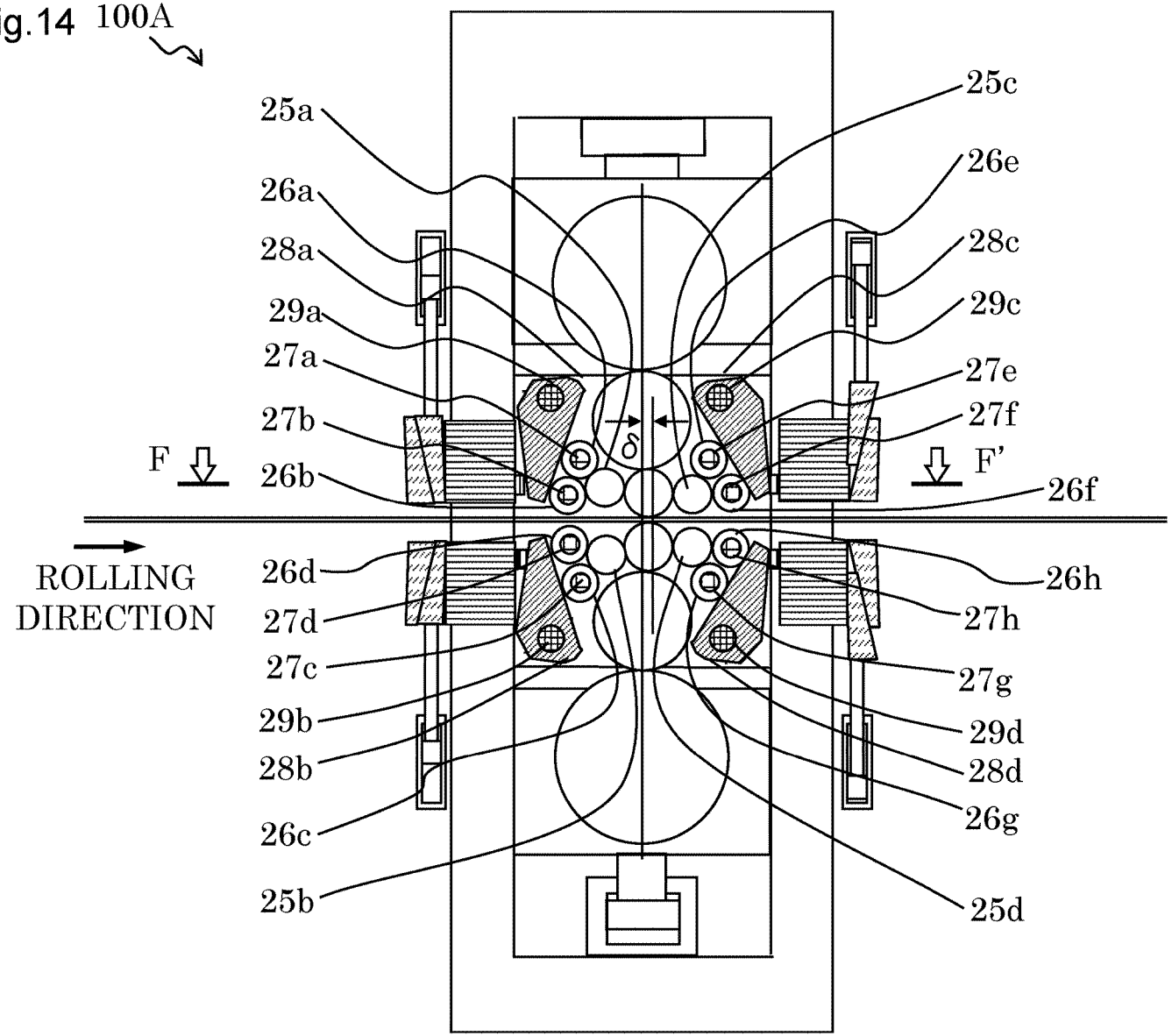
FIG. 14 is a diagram of assistance in explaining details of a six-high rolling mill according to a third embodiment of the present invention.
Figure 16:
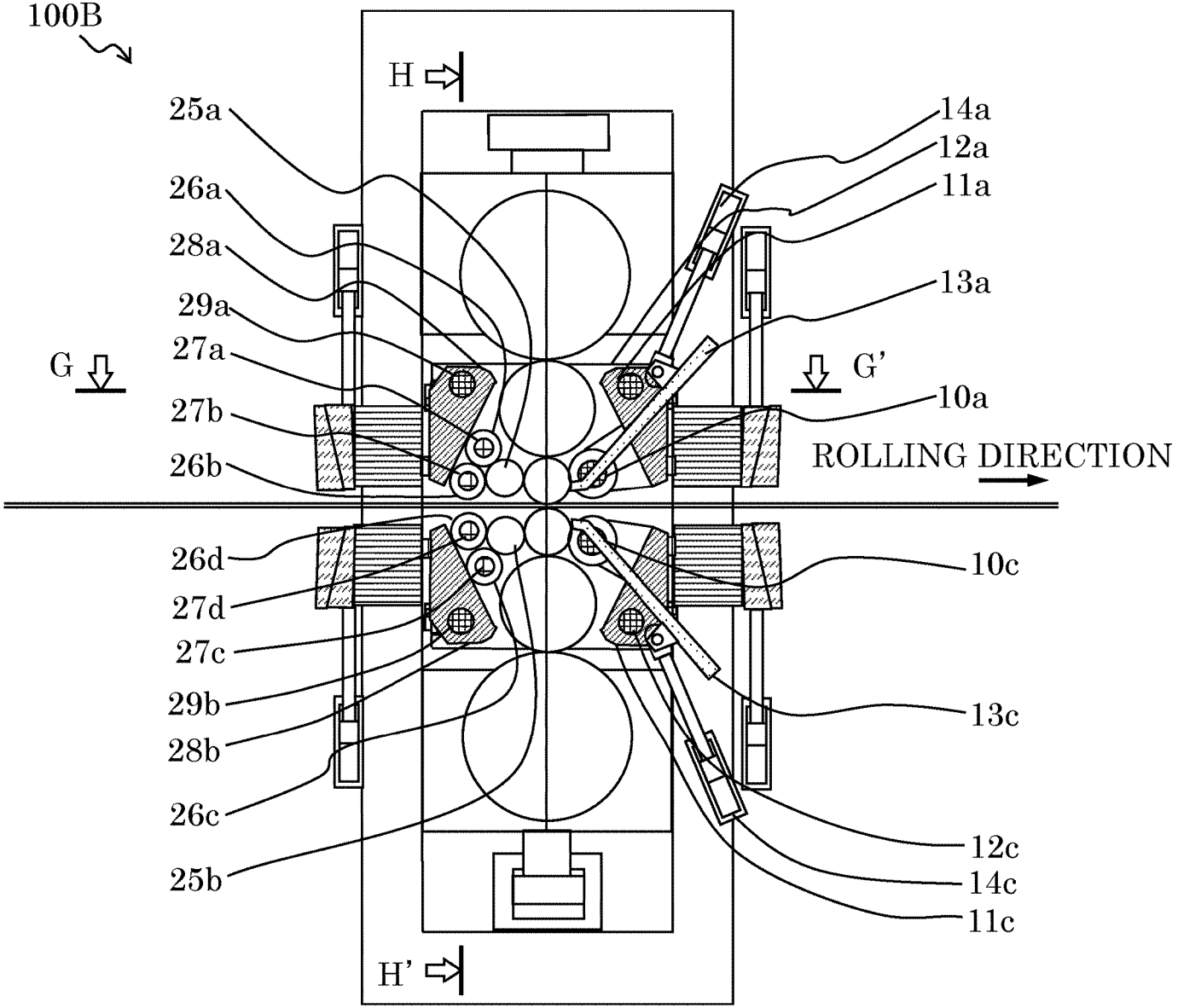
FIG. 16 is a front view of a six-high rolling mill according to a fourth embodiment of the present invention.

Incidentally, in the present embodiment, description has been made of a case where the support bearings 10*a*, 10*b*, 10*c*, 10*d*, 10*e*, 10*f*, 10*g*, and 10*h* are used as structural members that support the work rolls 2*a* and 2*b* on the work side and the drive side. However, a first support roll group can be used instead which includes support rolls having a structure changed so as to support the work rolls 2*a* and 2*b* on the work side and the drive side rather than over the entire length in the strip width direction among support rolls 25*a*, 25*b*, 25*c*, and 25*d* as shown in FIG. 14, FIG. 16, and the like to be described later.

In addition, description has been made of a case where both the work side and the drive side of the entry side and the exit side of the work rolls 2*a* and 2*b* are supported by the support bearings 10*a*, 10*b*, 10*c*, 10*d*, 10*e*, 10*f*, 10*g*, and 10*h*. However, it is possible to use, on one of the entry side and the exit side, the support bearings 10*a*, 10*b*, 10*c*, 10*d*, 10*e*, 10*f*, 10*g*, and 10*h* that support the work rolls 2*a* and 2*b* on the work side and the drive side, and use, on the other side, a first support roll group including support rolls supporting the work rolls 2*a* and 2*b* on the work side and the drive side.

Second Embodiment

Figure 11:
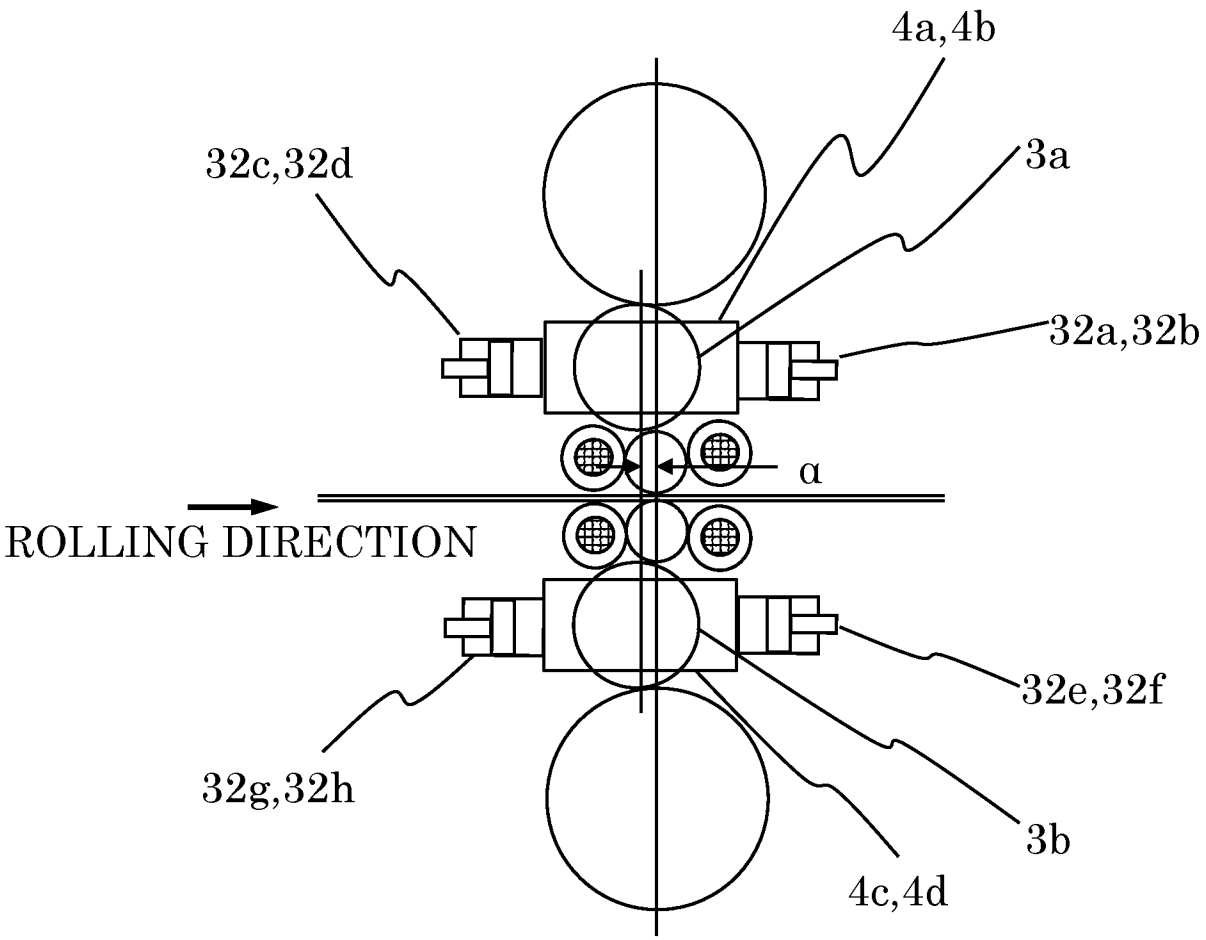
FIG. 11 is a front view of a six-high rolling mill according to a second embodiment of the present invention.
Figure 12:
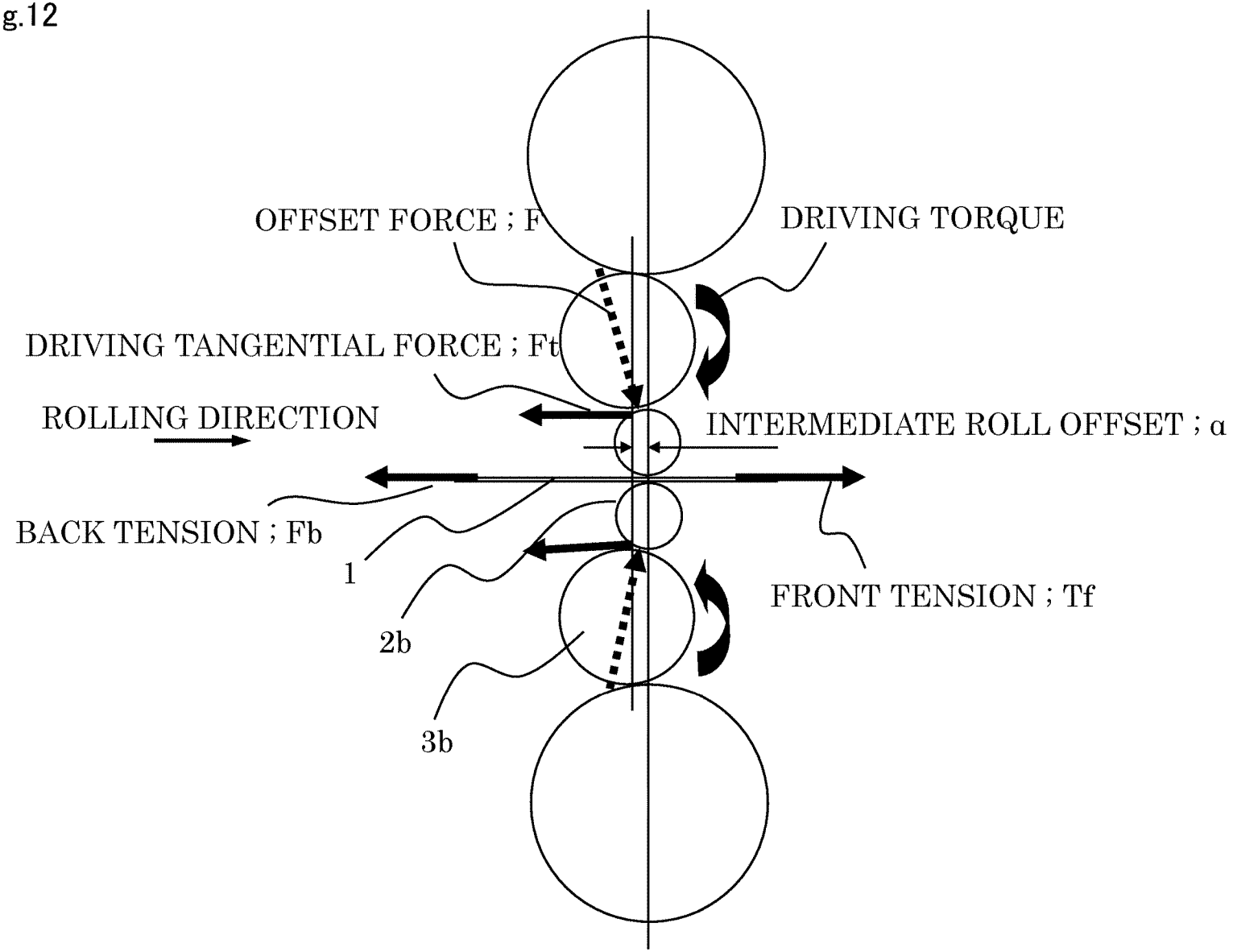
FIG. 12 is a diagram of assistance in explaining a state of an offset of intermediate rolls in the second embodiment.
Figure 13:
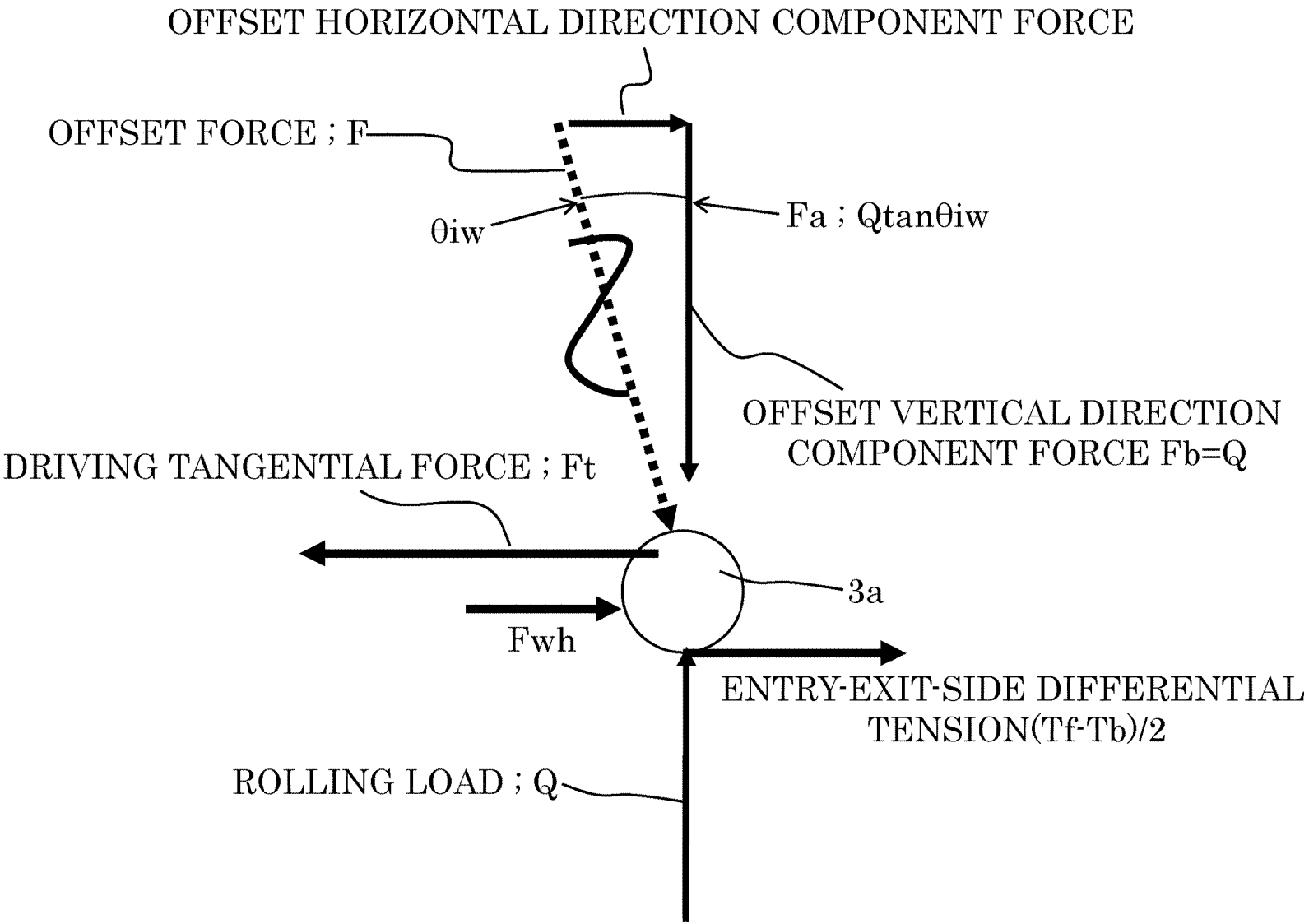
FIG. 13 is a diagram of assistance in explaining a balance between forces acting on work rolls at a time of the offset of the intermediate rolls in the second embodiment.

A rolling mill according to a second embodiment of the present invention will be described with reference to FIGS. 11 to 13. FIG. 11 is a front view of a six-high rolling mill according to the present embodiment. FIG. 12 is a diagram of assistance in explaining a state of an offset of intermediate rolls in the six-high rolling mill according to the present embodiment. FIG. 13 is a diagram of assistance in explaining a balance between forces acting on work rolls at a time of the offset of the intermediate rolls in the six-high rolling mill according to the present embodiment.

Incidentally, in the present embodiment, the same configurations as in the first embodiment are indicated by the same reference numerals, and description thereof will be omitted. The same is true for subsequent embodiments.

The second embodiment of the present invention has a structure that offsets the intermediate rolls 3*a* and 3*b* in the pass direction in addition to the multistage rolling mill 100 according to the first embodiment. Though the structure is not particularly limited, it suffices to be able to move in and out the intermediate roll chocks 4*a*, 4*b*, 4*c*, and 4*d* of the intermediate rolls 3*a* and 3*b* to the entry side or the exit side with respect to the pass direction.

For example, as shown in FIG. 11, the intermediate roll 3*a* is offset in the pass direction by an amount of offset $\alpha$ by the pushing or pulling of a hydraulic cylinder 32*a* on the work side and a hydraulic cylinder 32*b* on the drive side on the exit side and the pulling or pushing of a hydraulic cylinder 32*c* on the work side and a hydraulic cylinder 32*d* on the drive side on the entry side via bearings omitted for the convenience of illustration and the intermediate roll chocks 4*a* and 4*b*.

In addition, as shown in FIG. 11, the intermediate roll 3*b* is offset in the pass direction by an amount of offset $\alpha$ by the pushing or pulling of a hydraulic cylinder 32*e* on the work side and a hydraulic cylinder 32*f* on the drive side on the exit side and the pulling or pushing of a hydraulic cylinder 32*g* on the work side and a hydraulic cylinder 32*h* on the drive side on the entry side via bearings omitted for the convenience of illustration and the intermediate roll chocks 4*c* and 4*d*.

For example, when the hydraulic cylinders 32*a* and 32*b* push the intermediate roll 3*a* in the direction of the pass direction entry side, and the hydraulic cylinders 32*c* and 32*d* pull the intermediate roll 3*a* in the direction of the pass direction entry side by a corresponding amount, the intermediate roll 3*a* is offset to the pass direction entry side by the amount of offset α, and the amount of offset α is maintained.

Similarly, when the hydraulic cylinders 32*e* and 32*f* push the intermediate roll 3*b* in the direction of the pass direction entry side, and the hydraulic cylinders 32*g* and 32*h* pull the intermediate roll 3*b* in the direction of the pass direction entry side by a corresponding amount, the intermediate roll 3*b* is offset to the pass direction entry side by the amount of offset α, and the amount of offset α is maintained.

Conversely, when the hydraulic cylinders 32*a* and 32*b* pull the intermediate roll 3*a* in the direction of the pass direction exit side, and the hydraulic cylinders 32*c* and 32*d* push the intermediate roll 3*a* in the direction of the pass direction exit side by a corresponding amount, the intermediate roll 3*a* is offset to the pass direction exit side by the amount of offset α, and the amount of offset a is maintained.

Similarly, when the hydraulic cylinders 32*e* and 32*f* pull the intermediate roll 3*b* in the direction of the pass direction exit side, and the hydraulic cylinders 32*g* and 32*h* push the intermediate roll 3*b* in the direction of the pass direction exit side by a corresponding amount, the intermediate roll 3*b* is offset to the pass direction exit side by the amount of offset α, and the amount of offset α is maintained.

A method of setting the offset positions of the intermediate rolls 3*a* and 3*b* in the present embodiment will be described in the following with reference to FIG. 12 and FIG. 13.

Also in the present embodiment, the intermediate rolls 3*a* and 3*b* are driven, and therefore the work roll horizontal force Fwh applied to the work rolls 2*a* and 2*b* is expressed by the above-described Equation (1).

When an amount of offset of the intermediate rolls 3*a* and 3*b* is denoted as α as shown in FIG. 12 and FIG. 13, θiw in Equation (1) is obtained by Equation (4) shown in the following in the present embodiment.

$$\mathrm{Sin}(\theta iw)=\alpha/((Di+Dw)/2)) \quad (4)$$

where Dw and Di in Equation (4) respectively denote the diameter of the work rolls 2*a* and 2*b* and the diameter of the intermediate rolls 3*a* and 3*b*.

In addition, the driving tangential force Ft in Equation (1) is obtained by the above-described Equation (3) also in the present embodiment.

That is, it is clear from these Equations (1), (3), and (4) that the work roll horizontal force Fwh applied to the work rolls 2*a* and 2*b* can be reduced by changing the intermediate roll offset amount α.

Hence, it is clear that effects similar to those of the first embodiment are obtained. For this purpose, the intermediate roll offset amount α is set to be a value such that the work roll deflection ξ is a value in the vicinity of zero or a fixed value as an allowable value.

Other configurations and operations are substantially the same configurations and operations as those of the rolling mill according to the foregoing first embodiment, and therefore details thereof will be omitted.

Effects substantially similar to those of the rolling mill according to the foregoing first embodiment are obtained also by moving in and out the chocks of the intermediate rolls 3*a* and 3*b* to the entry side or the exit side with respect to the pass direction as in the rolling mill according to the second embodiment of the present invention.

Incidentally, description has been made of cases where only the work rolls 2*a* and 2*b* are offset in the first embodiment and only the intermediate rolls 3*a* and 3*b* are offset in the second embodiment. However, in the present invention, in principle, it suffices to be able to reduce the work roll horizontal force Fwh applied to the work rolls 2*a* and 2*b*. It is important for this purpose to adjust relative positional relation in the rolling direction between the work rolls 2*a* and 2*b* and the intermediate rolls 3*a* and 3*b*.

Hence, it is also possible to offset both the work rolls 2*a* and 2*b* and the intermediate rolls 3*a* and 3*b* so as to reduce the work roll horizontal force Fwh applied to the work rolls 2*a* and 2*b*.

Third Embodiment

Figure 15:
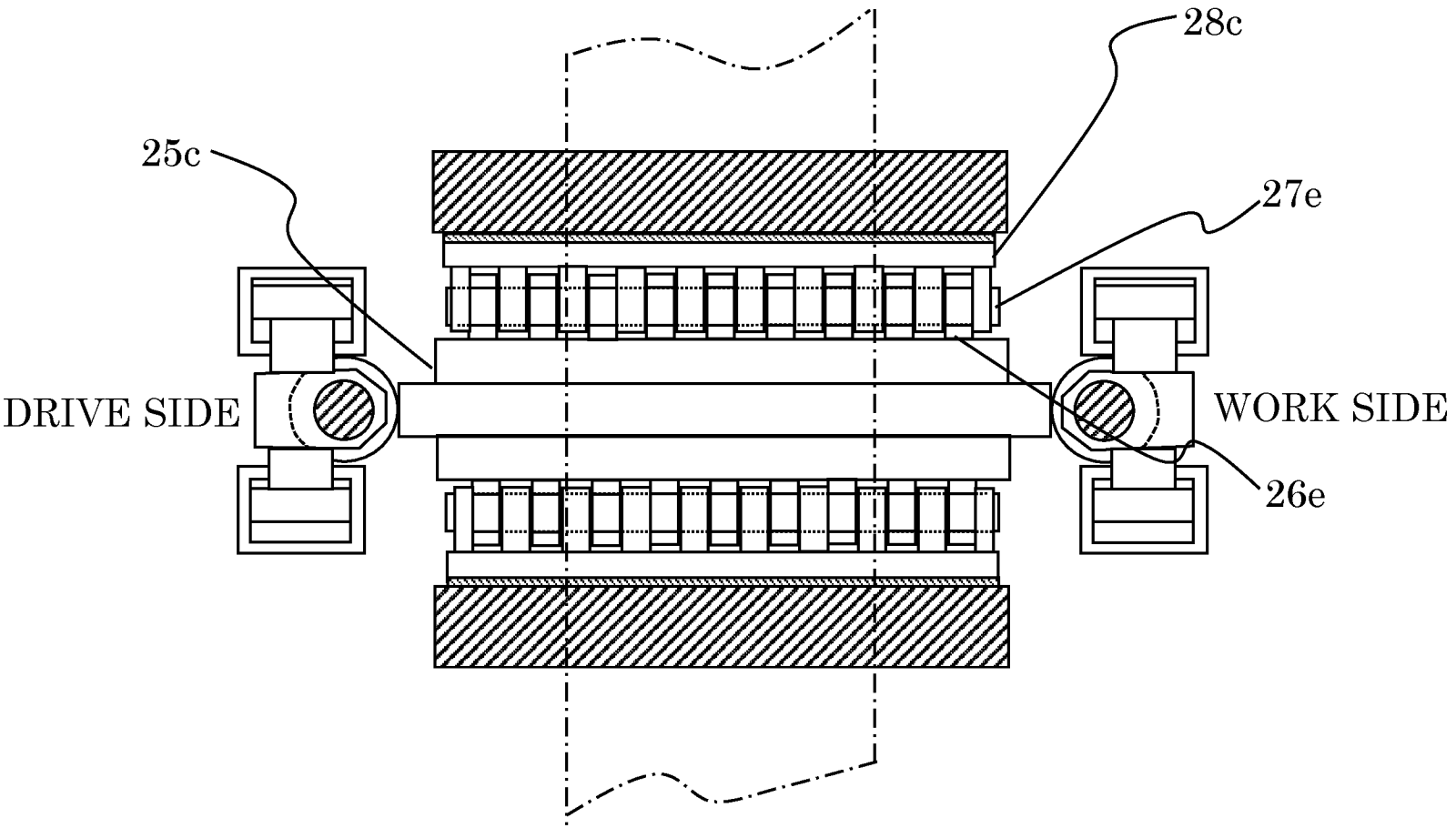
FIG. 15 is a sectional view taken in the direction of arrows F-F' in FIG. 14.

A rolling mill according to a third embodiment of the present invention will be described with reference to FIG. 14 and FIG. 15. FIG. 14 is a diagram of assistance in explaining details of a six-high rolling mill according to the present embodiment. FIG. 15 is a sectional view taken in the direction of arrows F-F' in FIG. 14.

As shown in FIG. 14 and FIG. 15, in a multistage rolling mill 100A according to the present embodiment, as in the multistage rolling mill 100 according to the first embodiment, the pair of upper and lower work rolls 2*a* and 2*b* is respectively in contact with and supported by the pair of upper and lower intermediate rolls 3*a* and 3*b*. Further, the pair of upper and lower intermediate rolls 3*a* and 3*b* is respectively in contact with and supported by the pair of upper and lower back-up rolls 5*a* and 5*b*.

In addition, also in the multistage rolling mill 100A according to the present embodiment, the intermediate roll chocks 4*a*, 4*b*, and 4*e* are attached to the roll neck portions of the intermediate roll 3*a* via bearings omitted for the convenience of illustration. In addition, the intermediate roll chocks 4*c*, 4*d*, and 4*f* are attached to the roll neck portions of the intermediate roll 3*b* via bearings omitted for the convenience of illustration.

On the other hand, in the multistage rolling mill 100A according to the present embodiment, arms 28*a* and 28*c* are swingably attached to the intermediate roll chocks 4*a* and 4*b* via shafts 29*a* and 29*c*, respectively.

In addition, support bearings 26*e* and 26*f* are attached to the arm 28*a* via shafts 27*a* and 27*b*, and support bearings 26*a* and 26*b* are attached to the arm 28*c* via shafts 27*e* and 27*f*.

Similarly, arms 28*b* and 28*d* are swingably attached to the intermediate roll chocks 4*c* and 4*d* via shafts 29*b* and 29*d*, respectively.

In addition, support bearings 26*c* and 26*d* are attached to the arm 28*b* via shafts 27*c* and 27*d*, and support bearings 26*g* and 26*h* are attached to the arm 28*d* via shafts 27*g* and 27*h*.

Furthermore, in the multistage rolling mill 100A according to the present embodiment, a support roll 25*a* is attached to the support bearings 26*a* and 26*b*, and a support roll 25*c* is attached to the support bearings 26*e* and 26*f*. These support rolls 25*a* and 25*c* support the work roll 2*a* over the entire length in the strip width direction, as shown in FIG. 15.

Similarly, a support roll 25*b* is attached to the support bearings 26*c* and 26*d*, and a support roll 25*d* is attached to the support bearings 26*g* and 26*h*. These support rolls 25*b* and 25*d* also support the work roll 2*b* over the entire length in the strip width direction, as shown in FIG. 15.

These support rolls 25*a*, 25*b*, 25*c*, and 25*d* correspond to second support rolls, and the support bearings 26*a*, 26*b*, 26*c*, 26*d*, 26*e*, 26*f*, 26*g*, and 26*h* supporting the support rolls 25*a*, 25*b*, 25*c*, and 25*d* correspond to a second support roll group. In addition, the intermediate roll chocks 4*a*, 4*b*, 4*c*, and 4*d* correspond to second intermediate roll chocks. These structures correspond to a second cluster arm.

In the multistage rolling mill 100A according to the present embodiment, the second cluster arm can be extracted to the work side of the housings 9*a* and 9*b*.

A first cluster arm can be inserted into a part from which the second cluster arm is extracted, the first cluster arm including the first support roll group or the support bearings 10*a*, 10*b*, 10*c*, 10*d*, 10*e*, 10*f*, 10*g*, and 10*h*, first intermediate roll chocks retaining the first support roll group or the support bearings 10*a*, 10*b*, 10*c*, 10*d*, 10*e*, 10*f*, 10*g*, and 10*h*, and the arms 11*a*, 11*b*, 11*c*, 11*d*, 11*e*, 11*f*, 11*g*, and 11*h* swingably coupled to the first intermediate roll chocks, as described in the foregoing first embodiment.

That is, in the multistage rolling mill 100A according to the present embodiment, the first cluster arm is extracted to the work side of the housings 9*a* and 9*b*, and the second cluster arm is inserted into the housings 9*a* and 9*b* instead, according to characteristics of the strip 1 or the like. In addition, conversely, the second cluster arm is extracted to the work side of the housings 9*a* and 9*b*, and the first cluster arm is inserted into the housings 9*a* and 9*b* instead.

Other configurations and operations are substantially the same configurations and operations as those of the rolling mill according to the foregoing first embodiment, and therefore details thereof will be omitted.

The rolling mill according to the third embodiment of the present invention also provides effects substantially similar to those of the rolling mill according to the foregoing first embodiment.

In addition, since the first cluster arm and the second cluster arm are selectively interchangeable, switching to a conventional multistage mill can be performed, so that operation flexibility is increased. For example, when the first cluster arm is used, the coolant spray headers 19*a* and 19*b* can be used, which enables effective cooling of the work rolls 2*a* and 2*b* and rolling at higher speed. In addition, when switching is performed to the second cluster arm, the work rolls 2*a* and 2*b* having a smaller diameter can be used, and therefore a harder rolling material can be rolled.

Fourth Embodiment

Figure 17:
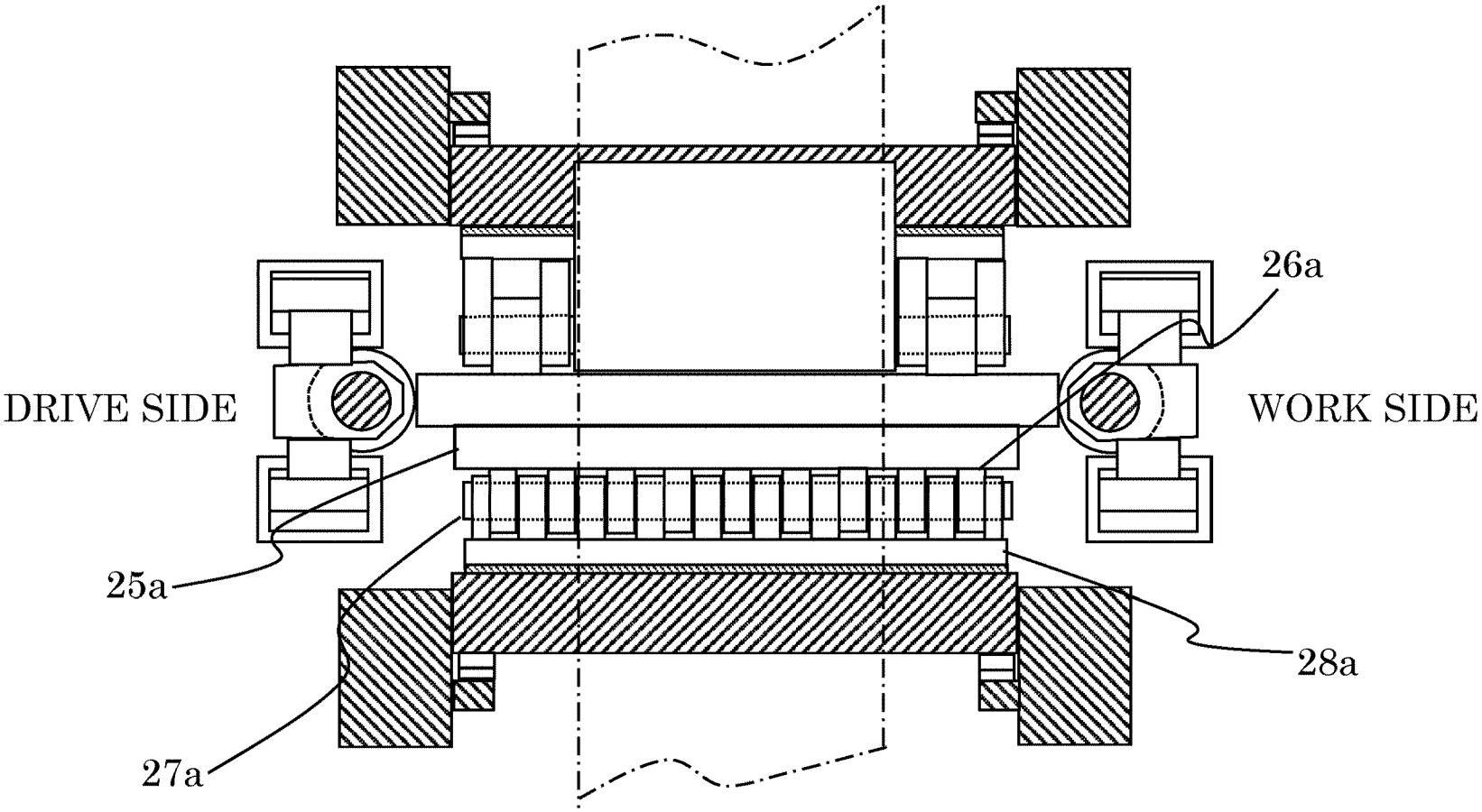
FIG. 17 is a sectional view taken in the direction of arrows G-G' in FIG. 16.
Figure 18:
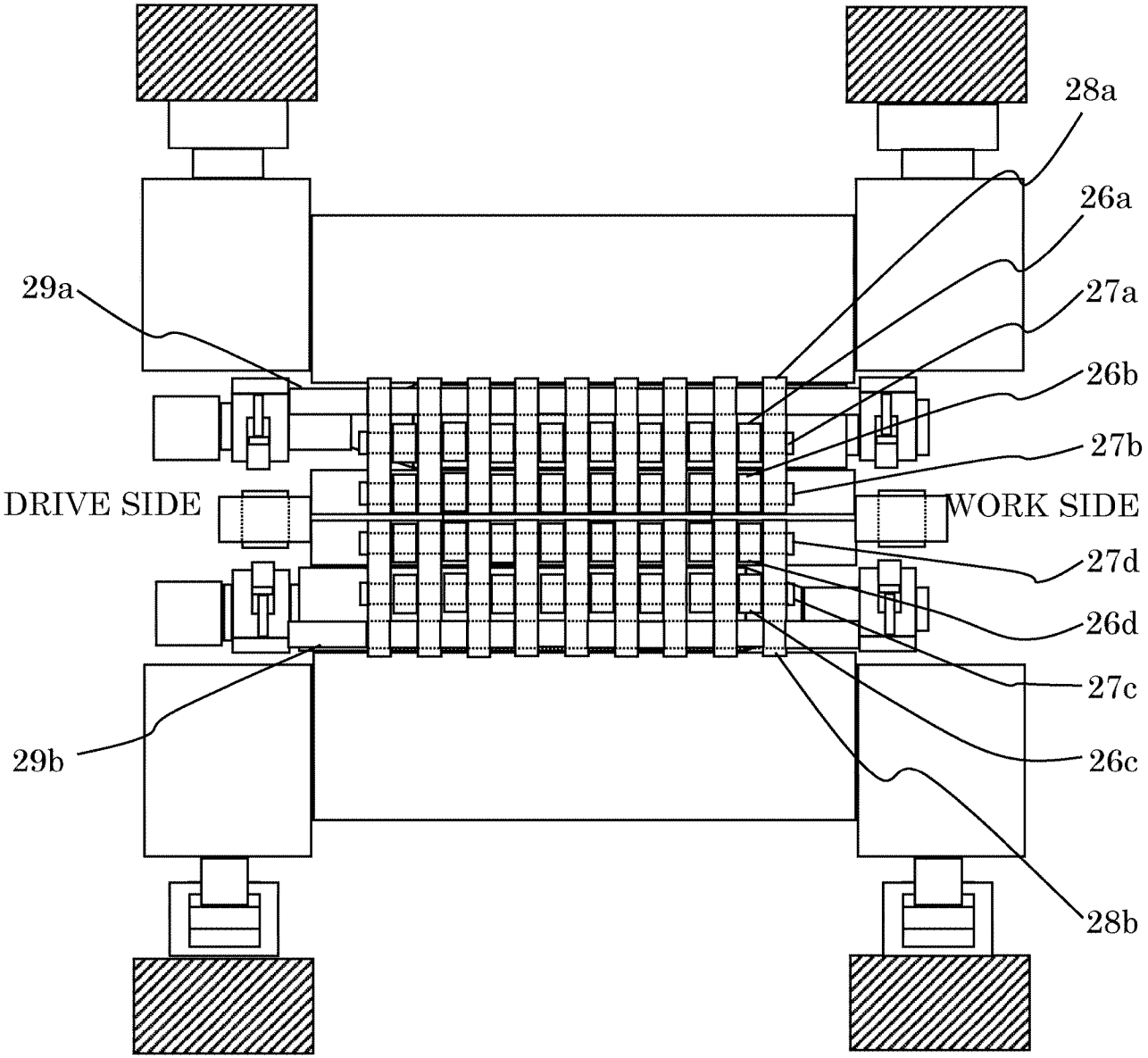
FIG. 18 is a sectional view taken in the direction of arrows H-H' in FIG. 16.

A rolling mill according to a fourth embodiment of the present invention will be described with reference to FIGS. 16 to 18. FIG. 16 is a front view of the six-high rolling mill according to the present embodiment. FIG. 17 is a sectional view taken in the direction of arrows G-G' in FIG. 16. FIG. 18 is a sectional view taken in the direction of arrows H-H' in FIG. 16.

As shown in FIGS. 16 to 18, also in a multistage rolling mill 100B according to the present embodiment, as in the multistage rolling mill 100 according to the first embodiment, the pair of upper and lower work rolls 2*a* and 2*b* is respectively in contact with and supported by the pair of upper and lower intermediate rolls 3*a* and 3*b*. Further, the pair of upper and lower intermediate rolls 3*a* and 3*b* is respectively in contact with and supported by the pair of upper and lower back-up rolls 5*a* and 5*b*.

In the multistage rolling mill 100B according to the present embodiment, as in the multistage rolling mill 100 according to the foregoing first embodiment, as shown in FIGS. 16 to 18, the exit side of the strip 1 is provided with the support bearings 10*a*, 10*b*, 10*c*, 10*d*, 10*e*, 10*f*, 10*g*, and 10*h*, third intermediate roll chocks retaining the support bearings 10*a*, 10*b*, 10*c*, 10*d*, 10*e*, 10*f*, 10*g*, and 10*h*, and the arms 11*a*, 11*b*, 11*c*, 11*d*, 11*e*, 11*f*, 11*g*, and 11*h* swingably coupled to the third intermediate roll chocks.

Alternatively, the first support roll group can be provided in place of the support bearings 10*a*, 10*b*, 10*c*, 10*d*, 10*e*, 10*f*, 10*g*, and 10*h*.

In addition, the exit side of the strip 1 is provided with the cobble guards 13*a* and 13*c* on the exit side of the strip width direction central part of the strip 1. Roles of the cobble guard 13*a*, 13*c* are the same as in the foregoing first embodiment. Incidentally, the coolant is sprayed onto roll surfaces after rolling on the exit side, and therefore the effects of cooling and shape control are greater than when the coolant spray headers are provided on the entry side.

On the other hand, in the multistage rolling mill 100B according to the present embodiment, as shown in FIG. 17 and FIG. 18, the pair of upper and lower work rolls 2*a* and 2*b* is rotatably supported over the entire length in the strip width direction by the support rolls 25*a* and 25*b*, respectively, on the entry side of the strip 1.

In addition, the support roll 25*a* is rotatably supported by the support bearings 26*a* and 26*b*. Further, the support bearings 26*a* and 26*b* are rotatably supported by the arm 28*a* via the shafts 27*a* and 27*b*, respectively.

Similarly, the support roll 25*b* is rotatably supported by the support bearings 26*c* and 26*d*. These support bearings 26*c* and 26*d* are rotatably supported by the arm 28*b* via the shafts 27*c* and 27*d*, respectively.

The arm 28*a* is swingably attached to the intermediate roll chocks 4*a* and 4*b* via the shaft 29*a*, and is supported in the pass direction by the side block 15*b*.

In addition, the arm 28*b* is swingably attached to the intermediate roll chocks 4*c* and 4*d* via the shaft 29*b*, and is supported in the pass direction by the side block 15*d*.

Support structures of the side blocks 15*b* and 15*d* are the same as in the multistage rolling mill 100 according to the first embodiment. A motor-driven worm jack system can be used in place of the system that moves in and out the tapered wedges 16*a*, 16*b*, 16*c*, 16*d*, 16*e*, 16*f*, 16*g*, and 16*h*.

The intermediate roll chocks 4*a*, 4*b*, 4*c*, and 4*d* correspond to the third intermediate roll chocks in the present embodiment.

Also in the multistage rolling mill 100B according to the present embodiment, the tapered wedges 16*e*, 16*f*, 16*g*, and 16*h* are inserted and pulled by the hydraulic cylinders 18*e*, 18*f*, 18*g*, and 18*h*, and the thickness of the tapered wedges 16*e*, 16*f*, 16*g*, and 16*h* can be thereby changed.

For example, when the entry side tapered wedges 16*e*, 16*f*, 16*g*, and 16*h* are pushed in, the thickness of the entry side tapered wedges 16*e*, 16*f*, 16*g*, and 16*h* is increased, the side blocks 15*b* and 15*d* are correspondingly moved to the exit side, and the work rolls 2*a* and 2*b* are moved to the exit side by an offset δ via the arms 28*a* and 28*b*, the shafts 27*a*, 27*b*, 27*c*, and 27*d*, the support bearings 26*a*, 26*b*, 26*c*, and 26*d*, and the support rolls 25*a* and 25*b*.

When the exit side tapered wedges 16*a*, 16*b*, 16*c*, and 16*d* are pulled at the same time, the thickness of the exit side tapered wedges 16*a*, 16*b*, 16*c*, and 16*d* is decreased, the side blocks 15*a* and 15*c* are correspondingly moved to the exit side, and the support bearings 10*a*, 10*b*, 10*c*, and 10*d* are also moved to the exit side by δ via the arms 11*a*, 11*b*, 11*c*, and 11*d* and the shafts 33*a*, 33*b*, 33*c*, and 33*d*, and support the work rolls 2*a* and 2*b*.

Incidentally, in the case of the multistage rolling mill 100B according to the present embodiment, even when the work roll offset amount δ of the work rolls 2*a* and 2*b* is zero, the work roll horizontal force Fwh applied to the work rolls 2*a* and 2*b* shown in FIG. 8 and the like is applied only in the entry side direction.

On the other hand, the entry sides of the work rolls 2*a* and 2*b* are supported over the entire length in the strip width direction by the support rolls 25*a* and 25*b*, and therefore the work rolls 2*a* and 2*b* are bent very little. Hence, in the case of the present embodiment, the amount of offset δ of the work rolls 2*a* and 2*b* and the intermediate rolls 3*a* and 3*b* can be set to zero.

Other configurations and operations are substantially the same configurations and operations as those of the rolling mill according to the foregoing first embodiment, and therefore details thereof will be omitted.

The rolling mill according to the fourth embodiment of the present invention also provides effects substantially similar to those of the rolling mill according to the foregoing first embodiment.

In addition, the exit side of the strip 1 is provided with the first support roll group or the support bearings, the third intermediate roll chocks retaining the first support roll group or the support bearings, and the arms 11*a*, 11*b*, 11*c*, 11*d*, 11*e*, 11*f*, 11*g*, and 11*h* swingably coupled to the third intermediate roll chocks, and the entry side of the strip 1 is provided with the second support roll group supporting the work rolls 2*a* and 2*b* over the entire length in the strip width direction of the work rolls 2*a* and 2*b*, the third intermediate roll chocks retaining the second support roll group, and the arms 28*a*, 28*b*, 28*c*, and 28*d* swingably coupled to the third intermediate roll chocks. Thus, the cobble guards for removing water on the exit side of the mill can be installed in a space of the center of the exit side.

Incidentally, while the present embodiment illustrates an example in which the support rolls 25*a* and 25*b* and the support bearings 26*a*, 26*b*, 26*c*, and 26*d* are arranged on the entry side, these can be installed only on the exit side, and a structure group providing support by the support bearing 10*a* and the like can be installed on the entry side.

In addition, an example has been illustrated in which the support rolls 25*a* and 25*b*, the support bearings 26*a*, 26*b*, 26*c*, and 26*d*, the shafts 27*a*, 27*b*, 27*c*, and 27*d*, and the arms 28*a* and 28*b* are swingably attached to the intermediate roll chocks 4*a*, 4*b*, 4*c*, and 4*d* via the shafts 29*a* and 29*b*. However, the support rolls 25*a* and 25*b*, the support bearings 26*a*, 26*b*, 26*c*, and 26*d*, the shafts 27*a*, 27*b*, 27*c*, and 27*d*, and the arms 28*a* and 28*b* can be swingably attached to the side blocks 15*b* and 15*d* via the shafts 29*a* and 29*b*.

Further, a structure can be adopted in which the support rolls 25*a* and 25*b* and the support bearings 26*a*, 26*b*, 26*c*, and 26*d* are directly supported by hydraulic cylinders or worm jacks.

Fifth Embodiment

A rolling mill according to a fifth embodiment of the present invention will be described with reference to FIGS. 14 to 18 described above.

In the multistage rolling mill according to the present embodiment, the pair of upper and lower work rolls 2*a* and 2*b* rolls the strip 1 as a material to be rolled.

As shown in FIGS. 14 to 18, the pair of upper and lower work rolls 2*a* and 2*b* is respectively in contact with and supported by the pair of upper and lower intermediate rolls 3*a* and 3*b*. Further, as shown in FIG. 15 and FIG. 18, the pair of upper and lower intermediate rolls 3*a* and 3*b* is respectively in contact with and supported by the pair of upper and lower back-up rolls 5*a* and 5*b*.

In addition, in the multistage rolling mill according to the present embodiment, the pair of upper and lower work rolls 2*a* and 2*b* is rotatably supported over the entire length in the strip width direction by the support rolls 25*a* and 25*b*, respectively, on the entry side of the pair of upper and lower work rolls 2*a* and 2*b*. In addition, those support rolls 25*a* and 25*b* are rotatably supported by the support bearings 26*a* and 26*b* or the support bearings 26*c* and 26*d*.

The work rolls 2*a* and 2*b* are rotatably supported over the entire length in the strip width direction by the support rolls 25*c* and 25*d*, respectively, on the exit side of the work rolls 2*a* and 2*b*. In addition, those support rolls 25*c* and 25*d* are rotatably supported by the support bearings 26*e* and 26*f* or the support bearings 26*g* and 26*h*.

In the present embodiment, these support rolls 25*a*, 25*b*, 25*c*, and 25*d* are provided on the entry side and/or the exit side of the work rolls 2*a* and 2*b*, and correspond to third support rolls supporting the work rolls 2*a* and 2*b* over the entire length in the strip width direction on the entry side and the exit side of the work rolls 2*a* and 2*b*. The support bearings 26*a*, 26*b*, 26*c*, 26*d*, 26*e*, 26*f*, 26*g*, and 26*h* supporting those support rolls 25*a*, 25*b*, 25*c*, and 25*d* correspond to a third support roll group.

Further, the support bearings 26*a* and 26*b* are rotatably supported by the arm 28*a* via the shafts 27*a* and 27*b*, respectively. The support bearings 26*c* and 26*d* are rotatably supported by the arm 28*b* via the shafts 27*c* and 27*d*, respectively. The support bearings 26*e* and 26*f* are rotatably supported by the arm 28*c* via the shafts 27*e* and 27*f*, respectively. The support bearings 26*g* and 26*h* are rotatably supported by the arm 28*d* via the shafts 27*g* and 27*h*, respectively.

These arms 28*a*, 28*b*, 28*c*, and 28*d* are respectively swingably attached to the intermediate roll chocks 4*a*, 4*b*, 4*c*, and 4*d* (chocks for the intermediate rolls 3*a* and 3*b*) via the shafts 29*a*, 29*b*, 29*c*, and 29*d*.

Furthermore, the arm 28*a* is supported in the pass direction by the side block 15*b*. The arm 28*b* is supported in the pass direction by the side block 15*d*. The arm 28*c* is supported in the pass direction by the side block 15*a*. The arm 28*d* is supported in the pass direction by the side block 15*c*.

Support structures of these side blocks 15*a*, 15*b*, 15*c*, and 15*d* are the same as in the multistage rolling mill 100 according to the first embodiment. The offset positions in the pass direction of the work rolls 2*a* and 2*b* are changed by moving in and out the support bearings 26*a*, 26*b*, 26*c*, 26*d*, 26*e*, 26*f*, 26*g*, and 26*h* to the entry side or the exit side with respect to the pass direction.

For example, when the entry side tapered wedges 16*e*, 16*f*, 16*g*, and 16*h* are pushed in, the thickness of the entry side tapered wedges 16*e*, 16*f*, 16*g*, and 16*h* is increased, the side blocks 15*b* and 15*d* are correspondingly moved to the exit side, and the work rolls 2*a* and 2*b* are moved to the exit side by an offset δ via the arms 28*a* and 28*b*, the shafts 27*a*, 27*b*, 27*c*, and 27*d*, the support bearings 26*a*, 26*b*, 26*c*, and 26*d*, and the support rolls 25*a* and 25*b*.

At the same time, when the exit side tapered wedges 16*a*, 16*b*, 16*c*, and 16*d* are pulled, the thickness of the exit side tapered wedges 16*a*, 16*b*, 16*c*, and 16*d* is decreased, the side blocks 15*a* and 15*c* are correspondingly moved to the exit side, and the support rolls 25*c* and 25*d* are also moved to the exit side by δ via the arms 28*c* and 28*d*, the shafts 27*e*, 27*f*, 27*g*, and 27*h*, and the support bearings 26*e*, 26*f*, 26*g*, and 26*h*, and support the work rolls 2*a* and 2*b*.

Incidentally, while the system that moves in and out the tapered wedges 16*a*, 16*b*, 16*c*, 16*d*, 16*e*, 16*f*, 16*g*, and 16*h* has been illustrated also in the present embodiment, a motor-driven worm jack system can be used.

Alternatively, the offset positions in the pass direction of the intermediate rolls 3*a* and 3*b* can be changed by adopting a structure in which the chocks of the intermediate rolls 3*a* and 3*b* (intermediate roll chocks 4*a*, 4*b*, 4*c*, and 4*d*) are moved in and out to the entry side or the exit side with respect to the pass direction as in the second embodiment.

In addition, the present embodiment illustrates an example in which the support rolls 25*a*, 25*b*, 25*c*, and 25*d*, the support bearings 26*a*, 26*b*, 26*c*, 26*d*, 26*e*, 26*f*, 26*g*, and 26*h*, the shafts 27*a*, 27*b*, 27*c*, 27*d*, 27*e*, 27*f*, 27*g*, and 27*h*, and the arms 28*a*, 28*b*, 28*c*, and 28*d* are swingably attached to the intermediate roll chocks 4*a*, 4*b*, 4*c*, and 4*d* via the shafts 29*a*, 29*b*, 29*c*, and 29*d*. However, the support rolls 25*a*, 25*b*, 25*c*, and 25*d*, the support bearings 26*a*, 26*b*, 26*c*, 26*d*, 26*e*, 26*f*, 26*g*, and 26*h*, the shafts 27*a*, 27*b*, 27*c*, 27*d*, 27*e*, 27*f*, 27*g*, and 27*h*, and the arms 28*a*, 28*b*, 28*c*, and 28*d* can be swingably attached to the side blocks 15*a*, 15*b*, 15*c*, and 15*d* via the shafts 29*a*, 29*b*, 29*c*, and 29*d*.

In addition, a structure can be adopted in which the support rolls 25*a*, 25*b*, 25*c*, and 25*d* and the support bearings 26*a*, 26*b*, 26*c*, 26*d*, 26*e*, 26*f*, 26*g*, and 26*h* are directly supported by hydraulic cylinders and worm jacks.

In the present embodiment described above, as for a range of the diameter of the work rolls 2*a* and 2*b*, small diameters such that D (work roll diameter)/B (strip width)=0.06 to 0.16 are particularly suitable. However, there is no limitation to the work roll diameters.

Other configurations and operations are substantially the same configurations and operations as those of the rolling mill according to the foregoing first embodiment, and therefore details thereof will be omitted.

Also in the multistage rolling mill according to the fifth embodiment of the present invention, the work roll horizontal force Fwh applied to the work rolls 2*a* and 2*b*, the work roll horizontal force Fwh being shown in Equation (1), can be reduced by changing the amount of offset δ of the work rolls 2*a* and 2*b*. As a result, loads on the support bearings 26*a*, 26*b*, 26*c*, 26*d*, 26*e*, 26*f*, 26*g*, and 26*h* supporting the work rolls 2*a* and 2*b* via the support rolls 25*a*, 25*b*, 25*c*, and 25*d* can be reduced.

Therefore, since the horizontal force applied to the work rolls 2*a* and 2*b* is reduced, it is possible to lengthen the life of the support bearings 26*a*, 26*b*, 26*c*, 26*d*, 26*e*, 26*f*, 26*g*, and 26*h*, in particular, in the support roll group, and reduce the size of the support bearings 26*a*, 26*b*, 26*c*, 26*d*, 26*e*, 26*f*, 26*g*, and 26*h*. Thus, work rolls having a smaller diameter can be used.

In addition, the third support roll group is rotatably installed on the arms 28*a*, 28*b*, 28*c*, and 28*d* swingably coupled to the chocks for the intermediate rolls 3*a* and 3*b*. An amount of offset of the work rolls can be adjusted with high accuracy by adjusting the pass direction positions of the arms 28*a*, 28*b*, 28*c*, and 28*d* by the side blocks 15*a*, 15*b*, 15*c*, and 15*d* capable of adjusting the pass direction positions.

Sixth Embodiment

Figure 19:
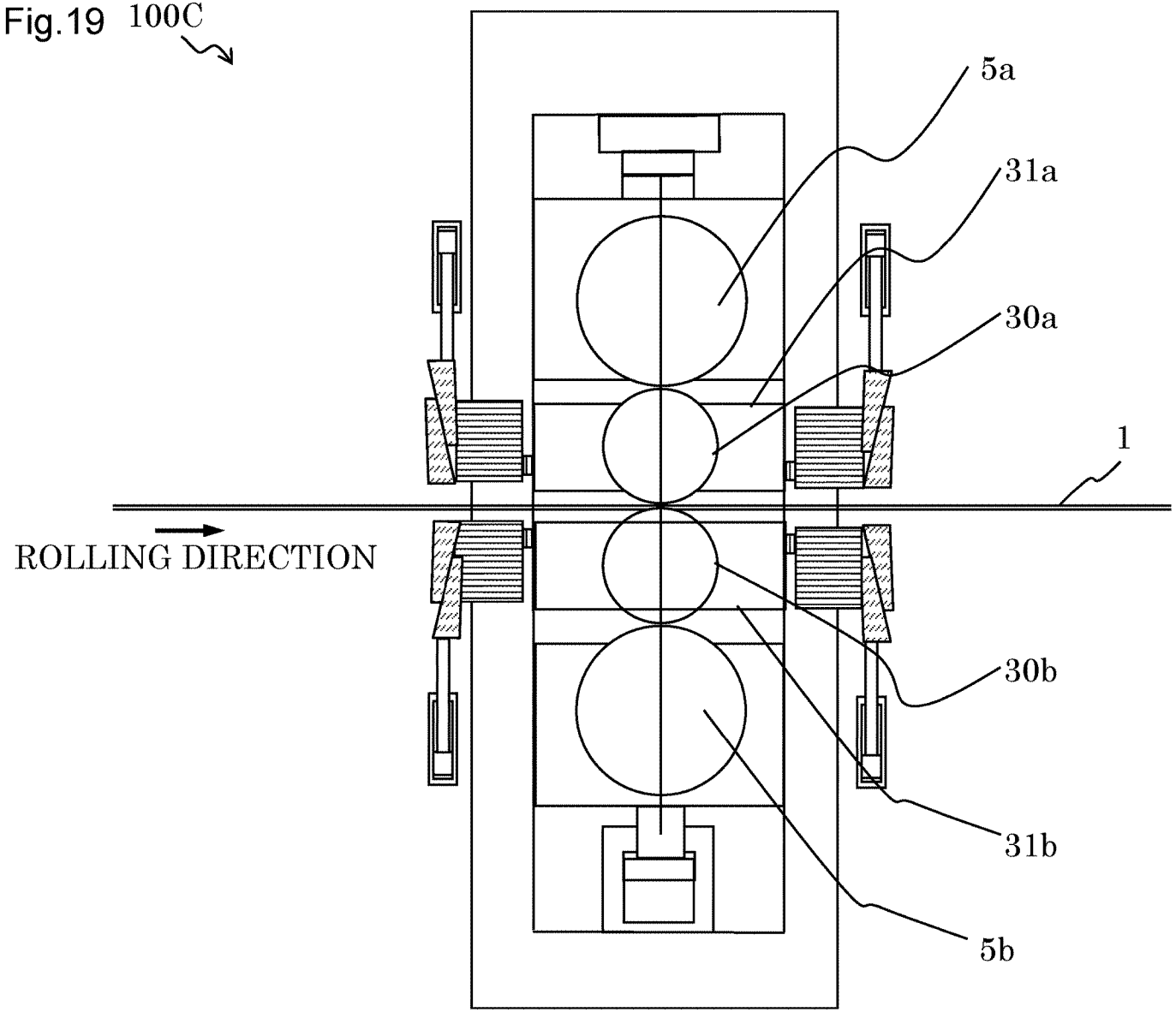
FIG. 19 is a detailed diagram of assistance in explaining a switched four-high rolling mill according to a sixth embodiment of the present invention.

A rolling mill according to a sixth embodiment of the present invention will be described with reference to FIG. 19. FIG. 19 is a detailed diagram of assistance in explaining a switched four-high rolling mill according to the present embodiment.

As shown in FIG. 19, one mode of a multistage rolling mill 100C according to the present embodiment is a four-high rolling mill, in which a pair of upper and lower work rolls 30*a* and 30*b* rolls the strip 1 as a material to be rolled.

This pair of upper and lower work rolls 30*a* and 30*b* has a larger diameter than the work rolls 2*a* and 2*b* shown in FIG. 3 and the like, and is respectively in contact with and supported by the pair of upper and lower back-up rolls 5*a* and 5*b*.

In addition, the pair of upper and lower work rolls 30*a* and 30*b* is rotatably attached to work roll chocks 31*a* and 31*b* via bearings omitted for the convenience of illustration on the work side and the drive side of the pair of upper and lower work rolls 30*a* and 30*b*.

The pair of upper and lower work rolls 30*a* and 30*b* provided with these work roll chocks 31*a* and 31*b* can be extracted from and inserted into the work side of the housings 9*a* and 9*b*, respectively.

In addition, in the multistage rolling mill 100C according to the present embodiment, the first cluster arm including the work rolls 2*a* and 2*b* and the intermediate rolls 3*a* and 3*b* as shown in FIGS. 3 to 7 described in the foregoing first embodiment can be extracted from and inserted into the housings 9*a* and 9*b*.

Hence, switching can be performed between the six-high mill in the case of using the first cluster arm and the four-high mill in the case of using the work rolls 30*a* and 30*b*.

Other configurations and operations are substantially the same configurations and operations as those of the rolling mill according to the foregoing first embodiment, and therefore details thereof will be omitted.

The rolling mill according to the sixth embodiment of the present invention also provides effects substantially similar to those of the rolling mill according to the foregoing first embodiment.

In addition, since the work rolls 2*a* and 2*b* and the intermediate rolls 3*a* and 3*b* are selectively interchangeable with the pair of large-diameter work rolls 30*a* and 30*b* having a larger diameter than the work rolls 2*a* and 2*b*, it is possible, for example, to use the work rolls 2*a* and 2*b* of a smaller diameter in the six-high mill suitable for rolling a hard material in rolling the hard material, and switch to the four-high mill and use the large-diameter work rolls 30*a* and 30*b* suitable for rolling a soft material in the case of rolling the soft material.

Seventh Embodiment

Figure 20:
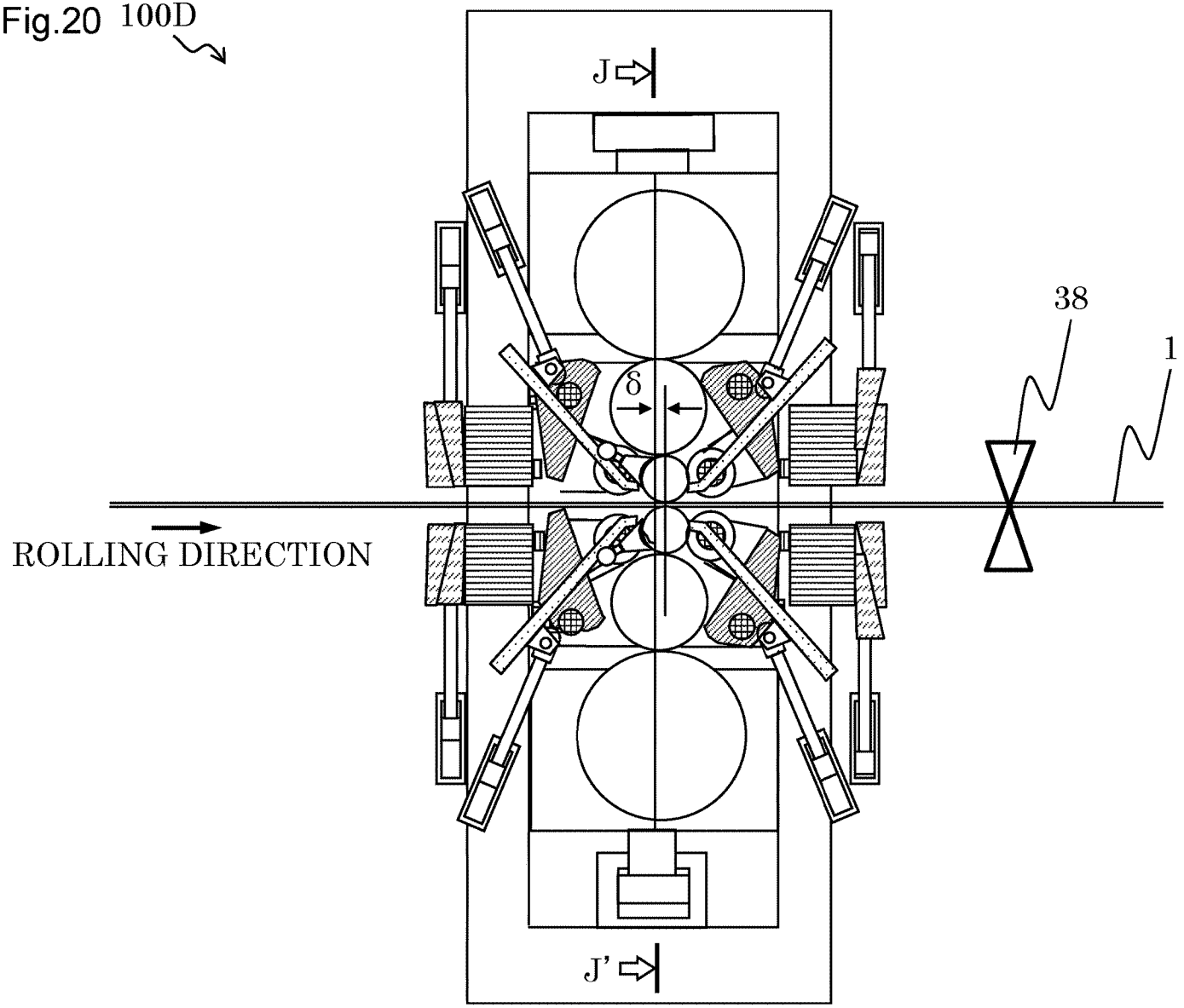
FIG. 20 is a diagram of assistance in explaining a six-high rolling mill according to a seventh embodiment of the present invention.
Figure 21:
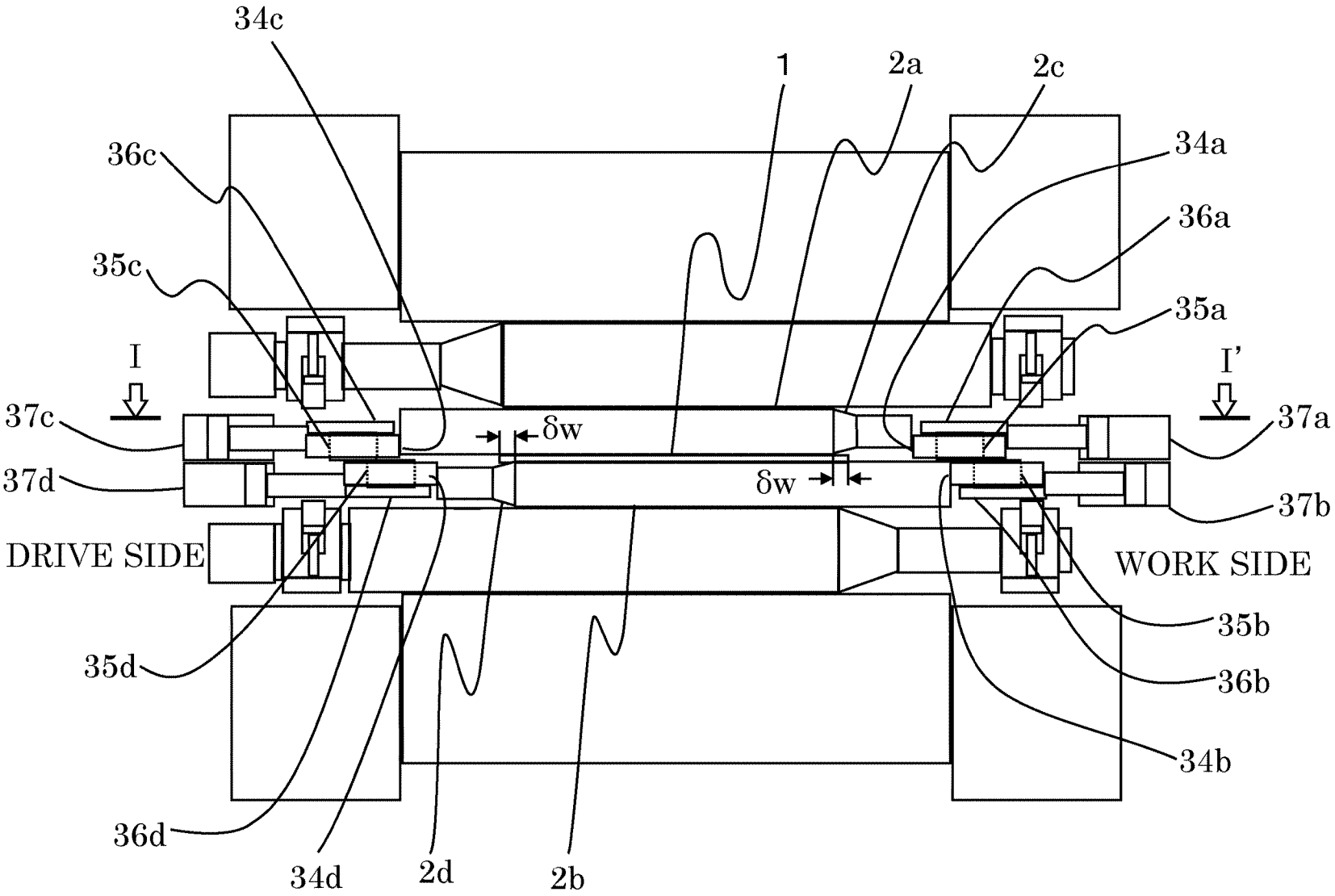
FIG. 21 is a diagram of assistance in explaining details of edge drop control in the six-high rolling mill according to the seventh embodiment.
Figure 22:
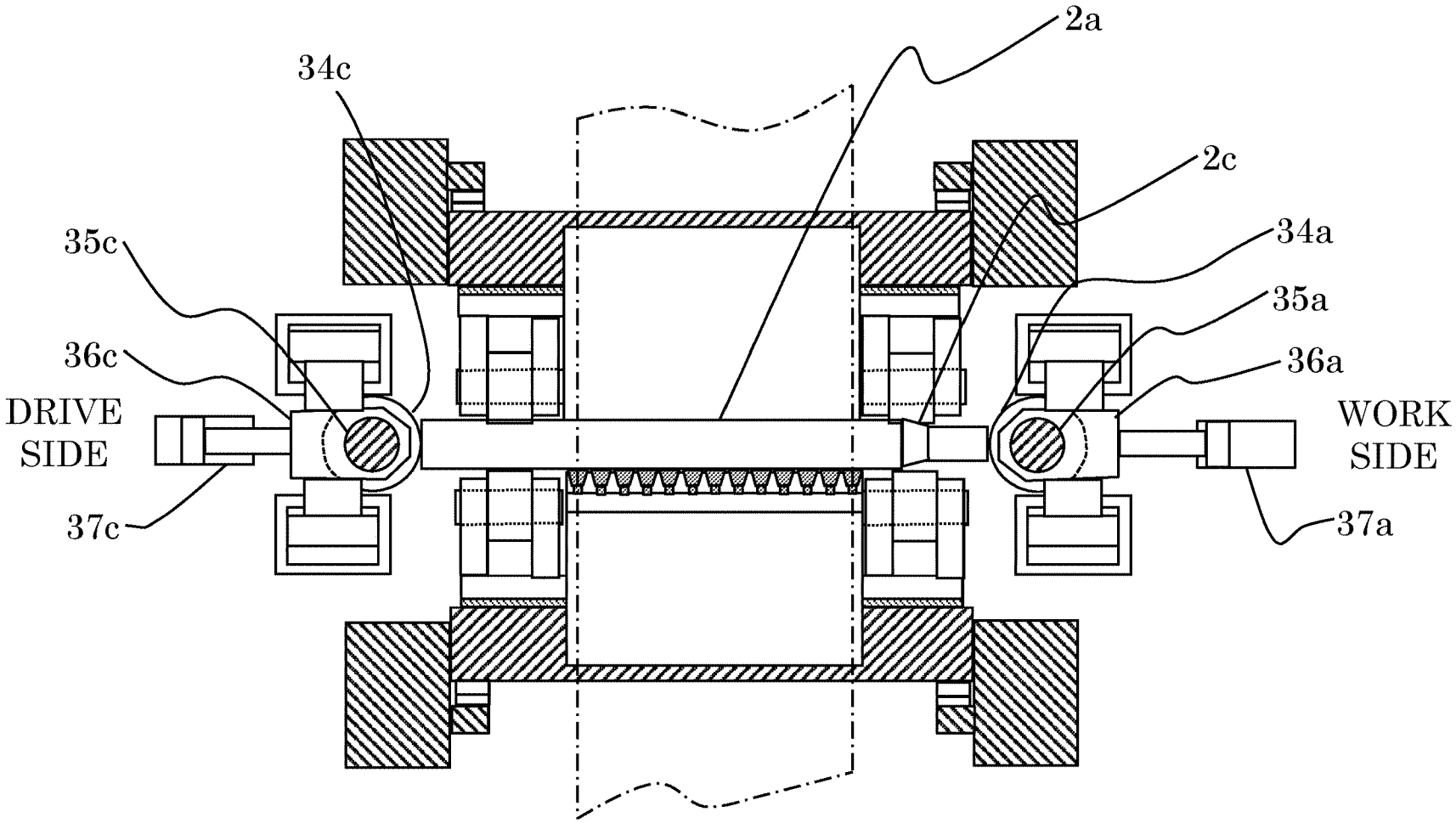
FIG. 22 is a sectional view taken in the direction of arrows I-I' in FIG. 21.

A rolling mill according to a seventh embodiment of the present invention will be described with reference to FIGS. 20 to 22. FIG. 20 is a diagram of assistance in explaining a six-high rolling mill according to the present embodiment. FIG. 21 is a diagram of assistance in explaining details of edge drop control in the six-high rolling mill according to the present embodiment (sectional view taken in the direction of arrows J-J' in FIG. 20). FIG. 22 is a sectional view taken in the direction of arrows I-I' in FIG. 21.

As shown in FIGS. 20 to 22, in a multistage rolling mill 100D according to the present embodiment, the pair of upper and lower work rolls 2*a* and 2*b* of the multistage rolling mill 100 according to the first embodiment respectively has tapered shaped roll shoulders 2*c* and 2*d* in roll body end positions in a direction of vertical point symmetry with respect to the strip width center of the strip 1.

Therefore, as shown in FIG. 21 and FIG. 22, the pair of upper and lower work rolls 2*a* and 2*b* is supported by thrust bearings 34*a* and 34*b* at work side axial ends, and is supported by thrust bearings 34*c* and 34*d* at drive side axial ends. The thrust bearings 34*a*, 34*b*, 34*c*, and 34*d* are respectively rotatably attached to brackets 36*a*, 36*b*, 36*c*, and 36*d* via shafts 35*a*, 35*b*, 35*c*, and 35*d*.

In addition, the brackets 36*a*, 36*b*, 36*c*, and 36*d* are respectively attached to hydraulic cylinders 37*a*, 37*b*, 37*c*, and 37*d* that shift the work rolls 2*a* and 2*b* in the roll axis direction.

Therefore, the upper work roll 2*a* is shifted to the roll axis direction drive side by the pushing of the hydraulic cylinder 37*a* and the pulling of the hydraulic cylinder 37*c*. On the other hand, the upper work roll 2*a* is shifted to the roll axis direction work side by the pulling of the hydraulic cylinder 37*a* and the pushing of the hydraulic cylinder 37*c*.

Similarly, the lower work roll 2*b* is shifted to the roll axis direction work side by the pulling of the hydraulic cylinder 37*b* and the pushing of the hydraulic cylinder 37*d*. On the other hand, the lower work roll 2*b* is shifted to the roll axis direction drive side by the pushing of the hydraulic cylinder 37*b* and the pulling of the hydraulic cylinder 37*d*.

Thus, by shifting the tapered shaped roll shoulders 2*c* and 2*d* of the work rolls 2*a* and 2*b* to the vicinities of strip edge portions, it is possible to reduce a sharp decreasing in strip thickness of the strip edge portions, which is referred to as an edge drop.

The following description will be made of a method of reducing the edge drop by shifting the work rolls 2*a* and 2*b* having the tapered shaped roll shoulders 2*c* and 2*d*.

First, with the work rolls 2*a* and 2*b* provided with the tapered shaped roll shoulders 2*c* and 2*d* in a direction of vertical point symmetry, let δw be a distance from a roll shoulder position to a strip edge, as shown in FIG. 21.

In addition, a strip thickness gauge 38 that measures strip thickness at one point or a plurality of points in the vicinities of the strip edge portions on the work side and the drive side is provided on the exit side of the multistage rolling mill 100D.

When the strip thickness at the one point or the plurality of points in the vicinity of the strip edge portion measured on the work side is smaller than a predetermined strip thickness, the upper work roll 2*a* is shifted to the drive side as a roll axis width decreasing direction. That is, the upper work roll 2*a* is shifted in a direction of increasing δw.

Conversely, when the measured strip thickness in the vicinity of the strip edge portion is larger than the predetermined strip thickness, the upper work roll 2*a* is shifted to the drive side as a roll axis width increasing direction. That is, the upper work roll 2*a* is shifted in a direction of decreasing δw.

In addition, when the strip thickness at the one point or the plurality of points in the vicinity of the strip edge portion measured on the drive side is different from the predetermined strip thickness, the lower work roll 2*b* is similarly shifted so as to attain the predetermined strip thickness.

Other configurations and operations are substantially the same configurations and operations as those of the rolling mill according to the foregoing first embodiment, and therefore details thereof will be omitted.

The rolling mill according to the seventh embodiment of the present invention also provides effects substantially similar to those of the rolling mill according to the foregoing first embodiment.

In addition, the work rolls 2*a* and 2*b* are provided with the tapered shaped roll shoulders 2*c* and 2*d* in the direction of vertical point symmetry, and the hydraulic cylinders 37*a*, 37*b*, 37*c*, and 37*d* that shift the work rolls 2*a* and 2*b* in the roll axis direction are further provided. It is thereby possible to reduce an edge drop as a sharp decrease in strip thickness of the strip edge portions, and consequently obtain a strip of high product quality with few edge drops.

Eighth Embodiment

Figure 23:
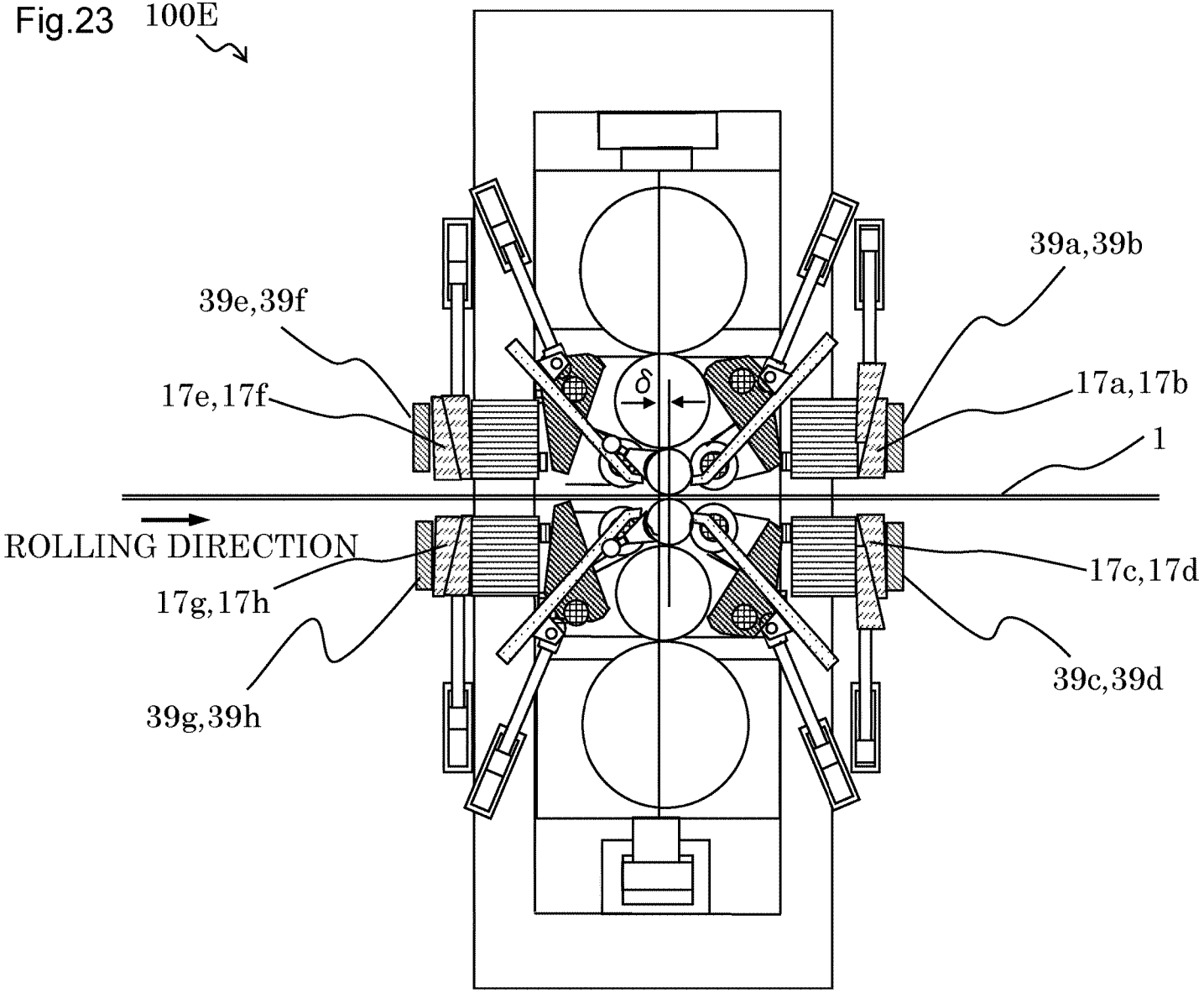
FIG. 23 is a diagram of assistance in explaining details of a six-high rolling mill according to an eighth embodiment of the present invention.
Figure 24:
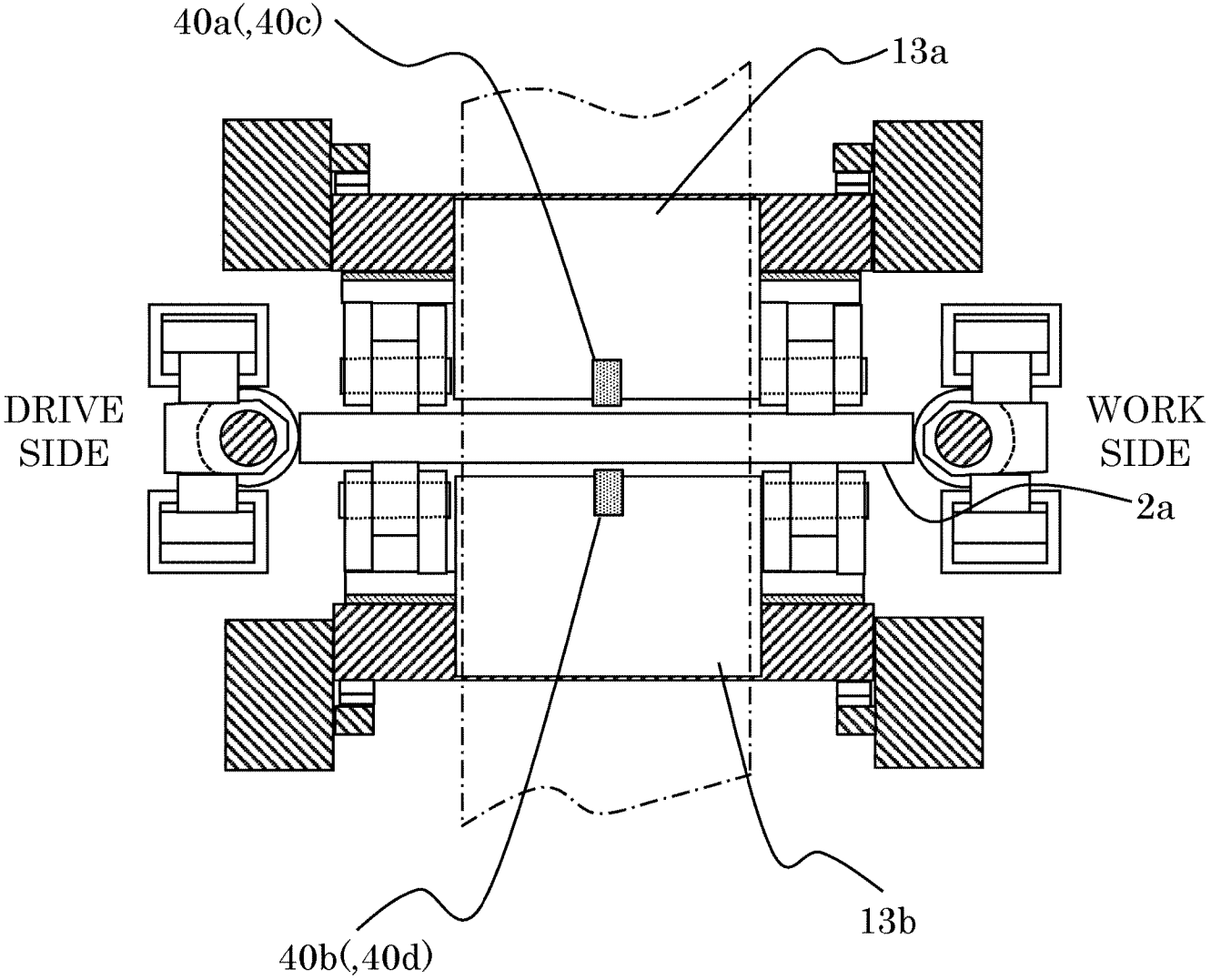
FIG. 24 is a diagram of assistance in explaining details of another six-high rolling mill according to the eighth embodiment.

A rolling mill according to an eighth embodiment of the present invention will be described with reference to FIG. 23 and FIG. 24. FIG. 23 is a diagram of assistance in explaining details of a six-high rolling mill according to the present embodiment. FIG. 24 is a diagram of assistance in explaining details of another six-high rolling mill according to the present embodiment.

A multistage rolling mill 100E according to the present embodiment shown in FIG. 23 has load cells 39*a*, 39*b*, 39*c*, 39*d*, 39*e*, 39*f*, 39*g*, and 39*h* further installed between the tapered wedges 17*a*, 17*b*, 17*c*, 17*d*, 17*e*, 17*f*, 17*g*, and 17*h* and the housings 9*a* and 9*b* in addition to the multistage rolling mill 100 according to the first embodiment.

These load cells 39*a*, 39*b*, 39*e*, and 39*f* measure the horizontal force Fwh applied to the entry side and the exit side of the upper work roll 2*a*. In addition, the load cells 39*c*, 39*d*, 39*g*, and 39*h* measure the horizontal force Fwh applied to the entry side and the exit side of the lower work roll 2*b*.

Furthermore, as in the first embodiment, the amount of offset δ in the pass direction of the work rolls 2*a* and 2*b* is set to be a value such that the horizontal force Fwh applied to the entry and exit sides of the pair of upper and lower work rolls 2*a* and 2*b* is a value in the vicinity of zero or a fixed value as an allowable value. It is thereby possible to suppress the work roll deflection ξ, and consequently reduce strip shape defects.

Alternatively, as in the second embodiment, the amount of offset α in the pass direction of the intermediate rolls 3*a* and 3*b* is set to be a value such that the horizontal force Fwh applied to the entry and exit sides of the pair of upper and lower work rolls 2*a* and 2*b* is a value in the vicinity of zero or a fixed value as an allowable value.

Incidentally, instead of directly measuring the horizontal force Fwh applied to the entry side and the exit side of the pair of upper and lower work rolls 2*a* and 2*b*, it is possible to measure the vertical driving torque of the pair of upper and lower intermediate rolls 3*a* and 3*b* by a torque meter omitted for the convenience of illustration, and compute the horizontal force Fwh applied to the entry and exit sides of the pair of upper and lower work rolls 2*a* and 2*b* from Equations (1), (2), (3), and (4).

Further, as shown in FIG. 24 (view of another embodiment, the view illustrating a section taken in the direction of arrows C-C'), as in a multistage rolling mill 100F according to the present embodiment, the horizontal direction deflection ξ of the pair of upper and lower work rolls 2*a* and 2*b* can be detected by installing gap sensors 40*a*, 40*b*, 40*c*, and 40*d* on the roll axis direction centers of the cobble guards 13*a*, 13*b*, 13*c*, and 13*d*, and measuring horizontal direction gaps of the pair of upper and lower work rolls 2*a* and 2*b*.

Then, the amount of offset δ in the pass direction of the work rolls 2*a* and 2*b* or the amount of offset α in the pass direction of the intermediate rolls 3*a* and 3*b* is set to be a value such that the deflection ξ of the pair of upper and lower work rolls 2*a* and 2*b* is a value in the vicinity of zero or a fixed value as an allowable value. As a result, strip shape defects can be reduced.

Other configurations and operations are substantially the same configurations and operations as those of the rolling mill according to the foregoing first embodiment, and therefore details thereof will be omitted.

The rolling mill according to the eighth embodiment of the present invention also provides effects substantially similar to those of the rolling mill according to the foregoing first embodiment.

In addition, the gap sensors 40*a*, 40*b*, 40*c*, and 40*d* or the load cells 39*a*, 39*b*, 39*c*, 39*d*, 39*e*, 39*f*, 39*g*, and 39*h* that detect amounts of bending of the work rolls 2*a* and 2*b* or the horizontal force are further provided, and the amount of offset in the pass direction of the work rolls 2*a* and 2*b* or the intermediate rolls 3*a* and 3*b* is changed on the basis of detection results of the gap sensors 40*a*, 40*b*, 40*c*, and 40*d* or the load cells 39*a*, 39*b*, 39*c*, 39*d*, 39*e*, 39*f*, 39*g*, and 39*h*. The amount of offset in the pass direction of the work rolls 2*a* and 2*b* or the intermediate rolls 3*a* and 3*b* can be thereby set, with higher accuracy, to be a value such that the horizontal direction deflection ξ of the work rolls 2*a* and 2*b* is a value in the vicinity of zero or a fixed value as an allowable value. A strip 1 of higher quality can be consequently obtained.

Ninth Embodiment

Figure 25:
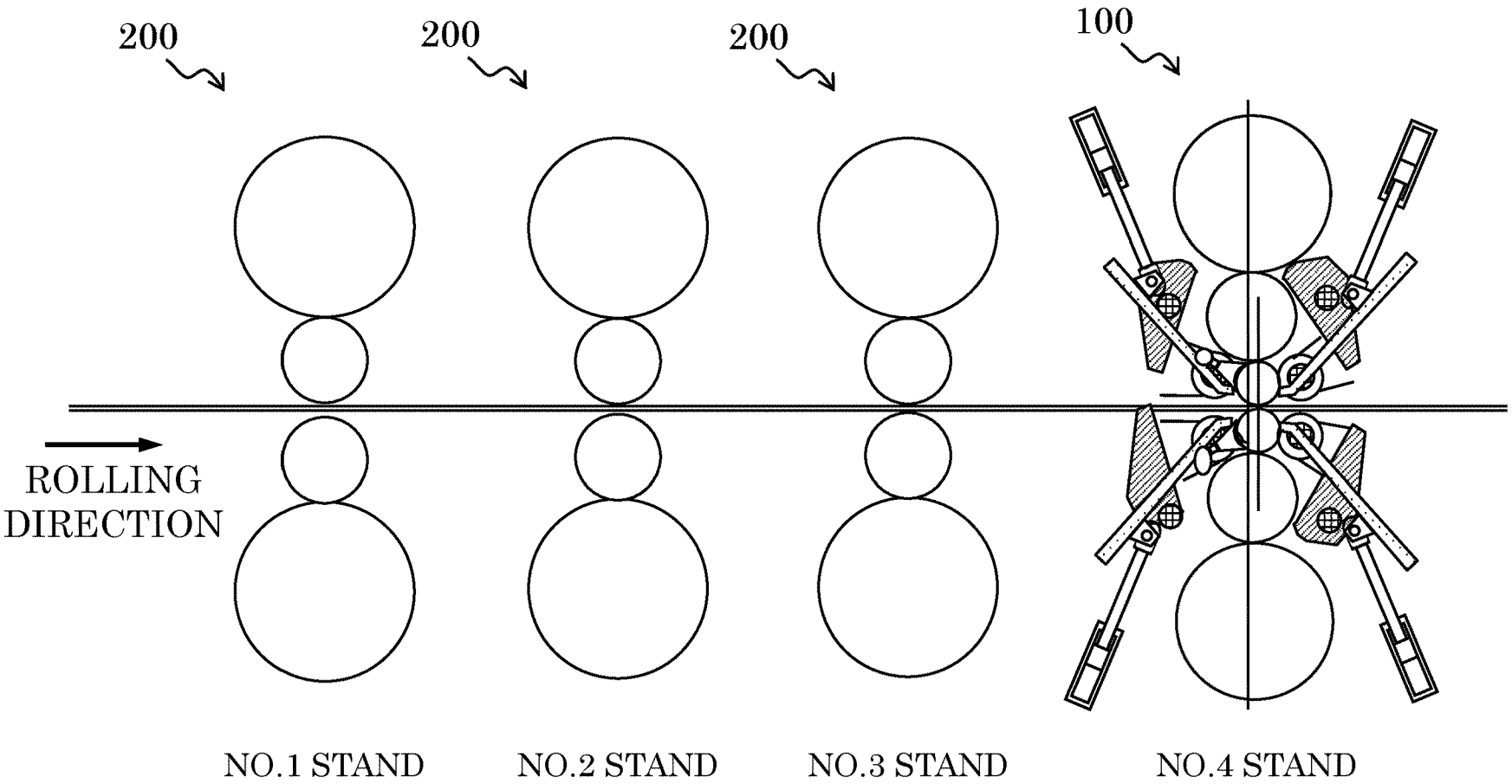
FIG. 25 is a diagram of assistance in explaining a tandem rolling mill according to a ninth embodiment of the present invention.

A rolling mill according to a ninth embodiment of the present invention will be described with reference to FIG. 25. FIG. 25 is a diagram of assistance in explaining a tandem rolling mill according to the present embodiment.

As shown in FIG. 25, a tandem rolling mill 1000 according to the present embodiment has four-high rolling mills 200 as described in the sixth embodiment in a first stand, a second stand, and a third stand, and has the multistage rolling mill 100 described in the first embodiment in a fourth stand.

Incidentally, the number of stands of the tandem rolling mill is not particularly limited, but can be two or more. In addition, it suffices for at least one stand to be the multistage rolling mill described in the first embodiment or the multistage rolling mill described in the second embodiment or the like, or all of the stands can be the multistage rolling mill according to the first embodiment or the like.

Other configurations and operations are substantially the same configurations and operations as those of the rolling mill according to the foregoing first embodiment, and therefore details thereof will be omitted.

The tandem rolling mill 1000 according to the ninth embodiment of the present invention includes at least one stand or more of the multistage rolling mills 100, 100A, 100B, 100C, 100D, 100E, and 100F and the four-high rolling mill 200 described in the first to eighth embodiments. The tandem rolling mill 1000 therefore provides effects substantially similar to those of the rolling mills according to the foregoing first embodiment and the like.

In addition, high-speed rolling, excellent strip shape, and excellent water removal on the exit side of the mill are desired in a stand in a later stage of the tandem rolling mill. Therefore, the installation of the coolant spray headers for work roll cooling on the entry side of the mill and for coolant zone control for strip shape correction and the installation of the cobble guards on the exit side of the mill as described in the first embodiment and the like are a very effective measure for this purpose.

In addition, in a case where the work roll shift rolling mill as described in the seventh embodiment is applied to the tandem mill, a greatest edge drop reduction effect is obtained when the work roll shift rolling mill as described in the seventh embodiment is applied to all of the stands. However, the application to only the first stand and the second stand provides a high return on investment because strip thickness is larger in these stands than in the other stands, and the edge drop reduction effect of a work roll shift is correspondingly greater in these stands than in the other stands.

<Others>

It is to be noted that the present invention is not limited to the foregoing embodiments, but includes various modifications. The foregoing embodiments are described in detail to describe the present invention in an easily understandable manner, and are not necessarily limited to embodiments including all of the described configurations.

In addition, a part of a configuration of a certain embodiment can be replaced with a configuration of another embodiment, and a configuration of another embodiment can be added to a configuration of a certain embodiment. In addition, for a part of a configuration of each embodiment, another configuration can be added, deleted, or substituted.

DESCRIPTION OF REFERENCE CHARACTERS

1 . . . Strip (metal strip)
2*a*, 2*b* . . . Work roll
2*c*, 2*d* . . . Roll shoulder
3*a*, 3*b* . . . Intermediate roll
3*c*, 3*d* . . . Roll shoulder
4*a*, 4*b*, 4*c*, 4*d*, 4*e*, 4*f* . . . Intermediate roll chock (chock, intermediate roll chock)
5*a*, 5*b* . . . Back-up roll
6*a*, 6*b*, 6*c*, 6*d* . . . Back-up roll chock
7*a*, 7*b* . . . Pass line adjusting device
8*a*, 8*b* . . . Hydraulic reduction cylinder
9*a*, 9*b* . . . Mill housing
10*a*, 10*b*, 10*c*, 10*d*, 10*e*, 10*f*, 10*g*, 10*h* . . . Support bearing
11*a*, 11*b*, 11*c*, 11*d*, 11*e*, 11*f*, 11*g*, 11*h* . . . Arm
12*a*, 12*b*, 12*c*, 12*d* . . . Shaft
13*a*, 13*b*, 13*c*, 13*d* . . . Cobble guard
14*a*, 14*b*, 14*c*, 14*d*, 14*e*, 14*f*, 14*g*, 14*h* . . . Hydraulic cylinder
15*a*, 15*b*, 15*c*, 15*d* . . . Side block
16*a*, 16*b*, 16*c*, 16*d*, 16*e*, 16*f*, 16*g*, 16*h* . . . Tapered wedge
17*a*, 17*b*, 17*c*, 17*d*, 17*e*, 17*f*, 17*g*, 17*h* . . . Tapered wedge
18*a*, 18*b*, 18*c*, 18*d*, 18*e*, 18*f*, 18*g*, 18*h* . . . Hydraulic cylinder
19*a*, 19*b* . . . Coolant spray header
20*a*, 20*b* . . . Thrust bearing
21*a*, 21*b* . . . Shaft
22*a*, 22*b* . . . Bracket
23*a*, 23*b*, 23*c*, 23*d* . . . Hydraulic cylinder
24*a*, 24*b*, 24*c*, 24*d* . . . Bending cylinder
25*a*, 25*b*, 25*c*, 25*d* . . . Support roll (second support roll group)
26*a*, 26*b*, 26*c*, 26*d*, 26*e*, 26*f*, 26*g*, 26*h* . . . Support bearing
27*a*, 27*b*, 27*c*, 27*d*, 27*e*, 27*f*, 27*g*, 27*h* . . . Shaft
28*a*, 28*b*, 28*c*, 28*d* . . . Arm
29*a*, 29*b*, 29*c*, 29*d* . . . Shaft
30*a*, 30*b* . . . Large diameter work roll
31*a*, 31*b* . . . Work roll chock
32*a*, 32*b*, 32*c*, 32*d*, 32*e*, 32*f*, 32*g*, 32*h* . . . Hydraulic cylinder
33*a*, 33*b*, 33*c*, 33*d*, 33*e*, 33*f*, 33*g*, 33*h* . . . Shaft
34*a*, 34*b*, 34*c*, 34*d* . . . Thrust bearing
35*a*, 35*b*, 35*c*, 35*d* . . . Shaft
36*a*, 36*b*, 36*c*, 36*d* . . . Bracket
37*a*, 37*b*, 37*c*, 37*d* . . . Hydraulic cylinder (shift device)
38 . . . Strip thickness gauge
39*a*, 39*b*, 39*c*, 39*d*, 39*e*, 39*f*, 39*g*, 39*h* . . . Load cell (sensor)
40*a*, 40*b*, 40*c*, 40*d* . . . Gap sensor (sensor)
41*a*, 41*b*, 41*c*, 41*d* . . . Shift cylinder (shift device)
100, 100A, 100B, 100C, 100D, 100E, 100F . . . Multistage rolling mill
200 . . . Four-high rolling mill
1000 . . . Tandem rolling mill

The invention claimed is:

1. A multistage rolling mill comprising:

a pair of work rolls rolling a metal strip;

a pair of intermediate rolls supporting the work rolls;

a pair of back-up rolls supporting the intermediate rolls;

a first support roll group or support bearings arranged on an entry side and/or an exit side of the work rolls, the first support roll group or the support bearings supporting the work rolls on an work side and a drive side; and a coolant spray header and/or a cobble guard disposed in a strip width direction central portion of the metal strip, wherein the intermediate rolls have tapered shaped roll shoulders in a direction of a vertical point symmetry, and have shift devices shifting the intermediate rolls in a roll axis direction, and wherein offset positions in a pass direction of at least either the work rolls or the intermediate rolls are changed by moving in and out at least either the first support roll group or the support bearings or chocks of the intermediate rolls to the entry side or the exit side with respect to the pass direction.

2. The multistage rolling mill according to claim 1, wherein the offset positions in the pass direction of the work rolls are changed by moving in and out the first support roll group or the support bearings to the entry side or the exit side with respect to the pass direction.

3. The multistage rolling mill according to claim 1, wherein the offset positions in the pass direction of the intermediate rolls are changed by moving in and out the chocks of the intermediate rolls to the entry side or the exit side with respect to the pass direction.

4. The multistage rolling mill according to claim 1, wherein the first support roll group or the support bearings are rotatably installed on arms swingably coupled to chocks of the intermediate rolls, and wherein pass direction positions of the arms are adjusted by side blocks capable of adjusting the pass direction positions.

5. The multistage rolling mill according to claim 1, wherein a first cluster arm and a second cluster arm are selectively interchangeable, wherein the first cluster arm includes the first support roll group or the support bearings, first intermediate roll chocks retaining the first support roll group or the support bearings, and arms swingably coupled to the first intermediate roll chocks, and wherein the second cluster arm includes a second support roll group supporting the work rolls over an entire length in the strip width direction on the entry side and the exit side of the work rolls, second intermediate roll chocks retaining the second support roll group, and arms swingably coupled to the second intermediate roll chocks.

6. The multistage rolling mill according to claim 1, wherein the multistage rolling mill has:

the first support roll group or the support bearings, third intermediate roll chocks retaining the first support roll group or the support bearings, and arms swingably coupled to the third intermediate roll chocks in an entry side or an exit side of the metal strip, and a second support roll group supporting the work rolls over an entire length in the strip width direction of the work rolls, the third intermediate roll chocks retaining the second support roll group, and arms swingably coupled to the third intermediate roll chocks in the exit side or the entry side of the metal strip.

7. The multistage rolling mill according to claim 1, wherein the work rolls and the intermediate rolls are selectively interchangeable with a pair of large-diameter work rolls having a larger diameter than the work rolls.

8. The multistage rolling mill according to claim 1, wherein the work rolls have tapered shaped roll shoulders in the direction of the vertical point symmetry, and the multistage rolling mill further includes shift devices shifting the work rolls in the roll axis direction.

9. The multistage rolling mill according to claim 1, further comprising:

sensors detecting amounts of deflection of the work rolls or horizontal forces of the work rolls, wherein an amount of the offset in the pass direction of the work rolls or the intermediate rolls is changed on a basis of the detection results of the sensors.

10. A tandem rolling mill comprising:

at least one stand or more of the multistage rolling mill according to claim 1.

* * * * *